US007663586B2

(12) United States Patent
Morita

(10) Patent No.: US 7,663,586 B2
(45) Date of Patent: Feb. 16, 2010

(54) REFERENCE VOLTAGE GENERATION CIRCUIT, DISPLAY DRIVER, ELECTRO-OPTICAL DEVICE, AND ELECTRONIC INSTRUMENT

(75) Inventor: Akira Morita, Suwa (JP)

(73) Assignee: Seiko Epson Corporation (JP)

( * ) Notice: Subject to any disclaimer, the term of this patent is extended or adjusted under 35 U.S.C. 154(b) by 653 days.

(21) Appl. No.: 11/365,912

(22) Filed: Mar. 1, 2006

(65) Prior Publication Data

US 2006/0197734 A1 Sep. 7, 2006

(30) Foreign Application Priority Data

Mar. 2, 2005 (JP) ..... 2005-057197

(51) Int. Cl.
*G09G 3/36* (2006.01)

(52) U.S. Cl. ..... 345/89; 345/87

(58) Field of Classification Search ..... 345/30
See application file for complete search history.

(56) References Cited

U.S. PATENT DOCUMENTS

| | | | | |
|---|---|---|---|---|
| 6,014,122 | A * | 1/2000 | Hashimoto | 345/98 |
| 6,020,869 | A | 2/2000 | Sasaki et al. | |
| 6,078,276 | A * | 6/2000 | Signell et al. | 341/146 |
| 6,100,879 | A | 8/2000 | Da Costa | |
| 6,459,416 | B1 | 10/2002 | Sasaki et al. | |
| 6,538,630 | B1 * | 3/2003 | Tanaka et al. | 345/94 |
| 6,727,874 | B2 | 4/2004 | Okuzono | |
| 6,778,163 | B2 * | 8/2004 | Ozawa | 345/96 |
| 6,801,178 | B2 | 10/2004 | Nitta et al. | |
| 7,023,458 | B2 | 4/2006 | Kudo et al. | |
| 7,193,637 | B2 | 3/2007 | Kudo et al. | |
| 7,317,461 | B2 | 1/2008 | Uchida et al. | |
| 7,391,398 | B2 | 6/2008 | Inoue | |
| 7,443,369 | B2 | 10/2008 | Takahashi et al. | |
| 7,511,693 | B2 | 3/2009 | Kudo et al. | |
| 2002/0036609 | A1 * | 3/2002 | Kajihara et al. | 345/87 |
| 2003/0151577 | A1 | 8/2003 | Morita | |
| 2003/0151578 | A1 | 8/2003 | Morita | |
| 2003/0151616 | A1 | 8/2003 | Morita | |
| 2003/0151617 | A1 | 8/2003 | Morita | |
| 2004/0179027 | A1 * | 9/2004 | Nakai et al. | 345/690 |
| 2008/0088259 | A1 | 4/2008 | Uchida et al. | |

(Continued)

FOREIGN PATENT DOCUMENTS

JP 03-59595 3/1991

(Continued)

*Primary Examiner*—Richard Hjerpe
*Assistant Examiner*—Dorothy Webb
(74) *Attorney, Agent, or Firm*—Harness, Dickey & Pierce, P.L.C.

(57) ABSTRACT

A reference voltage generation circuit, including: first to Jth (J is an integer greater than one) gamma correction data registers in which gamma correction data for generating a plurality of reference voltages is set; and a reference voltage select circuit which selects K select voltages from first to Lth (L is an integer greater than two, and K is a natural number smaller than L) select voltages arranged in potential descending order or potential ascending order and outputs the K select voltages as first to Kth reference voltages in potential descending order or potential ascending order, based on the gamma correction data set in one of the first to Jth gamma correction data registers, wherein the first to Kth reference voltages are output as the reference voltages.

11 Claims, 22 Drawing Sheets

U.S. PATENT DOCUMENTS

2009/0184985 A1 7/2009 Kudo et al.

FOREIGN PATENT DOCUMENTS

| | | |
|---|---|---|
| JP | 05-066738 | 3/1993 |
| JP | 06-202578 | 7/1994 |
| JP | 11-202834 | 7/1999 |
| JP | 2002-41004 | 2/2002 |
| JP | 2002-509621 | 3/2002 |
| JP | 2002-156948 | 5/2002 |
| JP | 2002-258813 | 9/2002 |
| JP | 2002-366112 | 12/2002 |
| JP | 2003-066915 | 3/2003 |
| JP | 2004-126626 | 4/2004 |
| JP | 2004-233743 | 8/2004 |
| JP | 2005-010520 | 1/2005 |
| JP | 2005-49418 | 2/2005 |

* cited by examiner

FIG.12

| SELECT VOLTAGE | GAMMA CORRECTION DATA | REFERENCE VOLTAGE |
|---|---|---|
| VG255 | REG255=1 | V63 |
| VG254 | REG254=0 | — |
| VG253 | REG253=0 | — |
| VG252 | REG252=1 | V62 |
| ⋮ | ⋮ | ⋮ |
| VG3 | REG3=0 | — |
| VG2 | REG2=1 | V1 |
| VG1 | REG1=1 | V0 |
| VG0 | REG0=0 | — |

FIG.17

| REG2 | REG1 | REG0 | V1 | V0 |
|---|---|---|---|---|
| 1 | 1 | 0 | $V_{G2}$ | $V_{G1}$ |
| 1 | 0 | 1 | $V_{G2}$ | $V_{G0}$ |
| 0 | 1 | 1 | $V_{G1}$ | $V_{G0}$ |

REFERENCE VOLTAGE GENERATION CIRCUIT, DISPLAY DRIVER, ELECTRO-OPTICAL DEVICE, AND ELECTRONIC INSTRUMENT

Japanese Patent Application No. 2005-57197, filed on Mar. 2, 2005, is hereby incorporated by reference in its entirety.

BACKGROUND OF THE INVENTION

The present invention relates to a reference voltage generation circuit, a display driver, an electro-optical device, and an electronic instrument.

An electro-optical device represented by a liquid crystal display (LCD) panel has been widely provided in a portable electronic instrument. On the other hand, the electro-optical device is required to display an image rich in color tone by increasing the number of grayscales.

An image signal for displaying an image is generally gamma-corrected corresponding to the display characteristics of a display device. In an electro-optical device, a reference voltage corresponding to grayscale data which determines a grayscale value is selected from a plurality of reference voltages, and the pixel transmissivity is changed based on the selected reference voltage. Therefore, gamma correction is realized by changing the voltage level of each reference voltage.

The reference voltage is generated by dividing the voltage across a ladder resistor circuit by using resistor elements of the ladder resistor circuit, as disclosed in JP-A-2003-233354, JP-A-2003-233355, JP-A-2003-233356, and JP-A-2003-233357. Therefore, the voltage level of each reference voltage can be changed by changing the resistance of each resistor element.

However, more accurate gamma correction may be required along with an increase in resolution and diversification of an LCD panel. In this case, it is difficult to generate the reference voltage with high accuracy merely by changing the resistance of each resistor element of the ladder resistor circuit. In particular, it is difficult to generate a highly accurate reference voltage corresponding to the LCD panel by using a simple configuration when the type of LCD panel is changed. Therefore, control and the configuration for realizing different types of gamma correction become complicated.

However, the voltage level of the reference voltage to be corrected by gamma correction may differ depending on whether the LCD panel is a reflective type or a transparent type, or different colors may be preferred depending on the region in which the LCD panel is used. Or, when driving the LCD panel by using a polarity inversion drive method, the reference voltages used in a positive drive period cannot be directly used as the reference voltages used in a negative drive period when it is desired to increase the resolution.

Gamma correction data for controlling gamma correction may be set in a reference voltage generation circuit. However, as the number of bits of gamma correction data is increased along with an increase in the number of grayscale levels, the time required to set the gamma correction data may be increased, or power consumption required when setting the gamma correction data may be increased. Therefore, it is desirable that the gamma correction data be set at low power consumption even when the number of bits of gamma correction data is increased.

SUMMARY

According to a first aspect of the invention, there is provided a reference voltage generation circuit which generates a plurality of reference voltages to be used for gamma correction, the reference voltage generation circuit comprising:

first to Jth (J is an integer greater than one) gamma correction data registers in which gamma correction data for generating the reference voltages is set; and a reference voltage select circuit which selects K select voltages from first to Lth (L is an integer greater than two, and K is a natural number smaller than L) select voltages arranged in potential descending order or potential ascending order and outputs the K select voltages as first to Kth reference voltages in potential descending order or potential ascending order, based on the gamma correction data set in one of the first to Jth gamma correction data registers, wherein the first to Kth reference voltages are output as the reference voltages.

According to a second aspect of the invention, there is provided a display driver which drives data lines of an electro-optical device, the display driver comprising:

the above-described reference voltage generation circuit;

a voltage select circuit which selects a reference voltage corresponding to grayscale data from the first to Kth reference voltages from the reference voltage generation circuit, and outputs the selected reference voltage as a data voltage; and a driver circuit which drives the data lines based on the data voltage.

According to a third aspect of the invention, there is provided an electro-optical device comprising:

a plurality of scan lines;

a plurality of data lines;

a pixel electrode specified by one of the scan lines and one of the data lines;

a scan driver which scans the scan lines; and the above-described display driver which drives the data lines.

According to a fourth aspect of the invention, there is provided an electronic instrument comprising the above-described display driver.

According to a fifth aspect of the invention, there is provided an electronic instrument comprising the above-described electro-optical device.

BRIEF DESCRIPTION OF THE SEVERAL VIEWS OF THE DRAWING

FIG. 12 is diagram illustrative of an operation example of a reference voltage select circuit.

FIG. 17 is a diagram showing an operation example of the reference voltage select circuit shown in FIG. 15.

DETAILED DESCRIPTION OF THE EMBODIMENT

Figure 1:
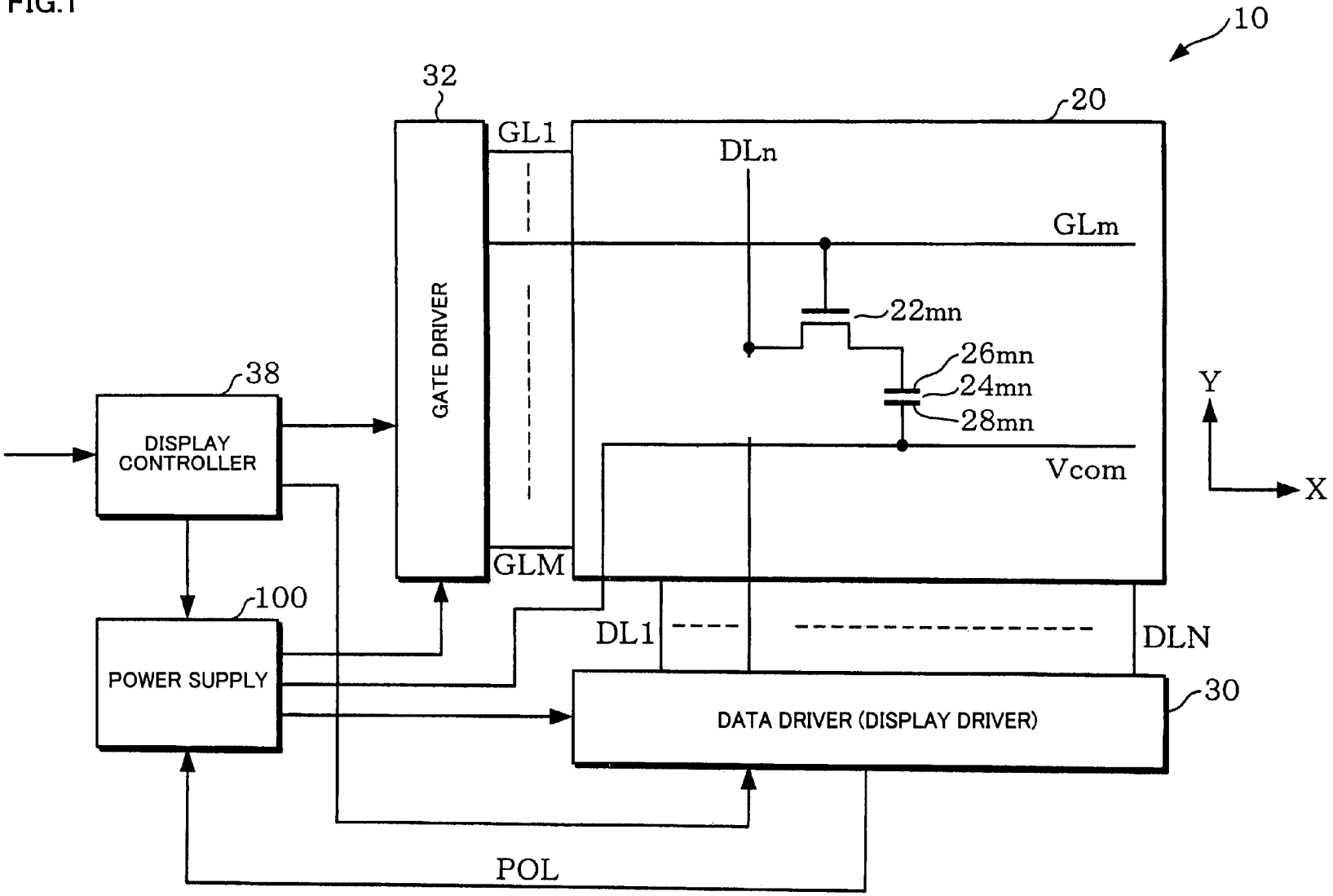
FIG. 1 is a diagram showing an outline of a configuration of a liquid crystal display device according to one embodiment of the invention.

The invention may provide a reference voltage generation circuit, a display driver, an electro-optical device, and an electronic instrument capable of easily realizing different types of gamma correction with high accuracy.

The invention may also provide a reference voltage generation circuit, a display driver, an electro-optical device, and an electronic instrument for realizing highly accurate gamma correction with a simple configuration.

The invention may further provide a reference voltage generation circuit, a display driver, an electro-optical device, and an electronic instrument enabling gamma correction data for performing highly accurate gamma correction to be set at low power consumption.

According to one embodiment of the invention, there is provided a reference voltage generation circuit which generates a plurality of reference voltages to be used for gamma correction, the reference voltage generation circuit comprising:

first to Jth (J is an integer greater than one) gamma correction data registers in which gamma correction data for generating the reference voltages is set; and a reference voltage select circuit which selects K select voltages from first to Lth (L is an integer greater than two, and K is a natural number smaller than L) select voltages arranged in potential descending order or potential ascending order and outputs the K select voltages as first to Kth reference voltages in potential descending order or potential ascending order, based on the gamma correction data set in one of the first to Jth gamma correction data registers, wherein the first to Kth reference voltages are output as the reference voltages.

In this embodiment, each of the first to Kth reference voltages can be selected from different voltage levels. For example, the voltage level of the reference voltage to be corrected by gamma correction may differ depending on whether the LCD panel (electro-optical device) is a reflective type or a transparent type, or different colors may be preferred depending on the region in which the LCD panel is used. In this case, gamma correction corresponding to the type of electro-optical device or regional preference can be easily realized by setting different types of gamma correction data in the gamma correction data registers and outputting desired reference voltages from the reference voltage select circuit.

The reference voltage generation circuit may comprise:

a serial/parallel conversion circuit which converts the serially input gamma correction data into parallel data of a given number of bits; and a level shifter which converts a signal level of each bit of the parallel data, wherein the parallel data having the signal level converted by the level shifter is set in each of the first to Jth gamma correction data registers in units of the number of bits.

In this embodiment, the serially input gamma correction data can be converted into the parallel data and set in the gamma correction data register. Therefore, instead of writing the gamma correction data into the gamma correction data register at high speed while generating clock signals in the number of bits of the gamma correction data, the gamma correction data can be written into the gamma correction data register at low speed while generating a smaller number of clock signals. This significantly reduces power consumption required when setting the gamma correction data.

Moreover, since it suffices that the level shifter convert the signal levels in the number of bits of the parallel data, an increase in the circuit scale can be prevented.

The reference voltage generation circuit may comprise:

a data setting register for designating one of the first to Jth gamma correction data registers in which the gamma correction data is set, wherein the gamma correction data having the signal level converted by the level shifter is set in one of the first to Jth gamma correction data registers corresponding to a value set in the data setting register.

The reference voltage generation circuit may comprise:

an output setting register for designating one of the first to Jth gamma correction data registers from which the gamma correction data is output, wherein the gamma correction data set in one of the first to Jth gamma correction data registers corresponding to a value set in the output setting register is output to the reference voltage select circuit.

In this embodiment, the gamma correction data can be set in the gamma correction data registers or different first to Kth reference voltages can be output with simple configuration.

In this reference voltage generation circuit, when changing voltage levels of the reference voltages in a given polarity inversion cycle by using a polarity inversion drive method, a gamma correction data register selected from the first to Jth gamma correction data registers in a positive drive period may be caused to differ from a gamma correction data register selected from the first to Jth gamma correction data registers in a negative drive period.

Even when the reference voltages are not symmetrical for each polarity of the polarity inversion drive, optimum gamma correction can be easily realized.

In this reference voltage generation circuit, the gamma correction data may be L-bit data, the data of each bit of the L-bit data being associated with one of the select voltages and indicating whether or not to output the select voltage as the reference voltage.

In this reference voltage generation circuit, the reference voltage select circuit may include:

a first switch element for outputting the first select voltage as the first reference voltage;

a second switch element for outputting the second select voltage as the first reference voltage;

a third switch element for outputting the second select voltage as the second reference voltage; and a fourth switch element for outputting the third select voltage as the second reference voltage, wherein the first switch element outputs the first select voltage as the first reference voltage on condition that the first switch element is enabled by the data of a first bit of the gamma correction data;

wherein the second switch element outputs the second select voltage as the first reference voltage on condition that the second switch element is disabled by the data of the first bit of the gamma correction data and enabled by the data of a second bit of the gamma correction data;

wherein the third switch element outputs the second select voltage as the second reference voltage on condition that the third switch element is enabled by the data of the first bit of the gamma correction data and enabled by the data of the second bit of the gamma correction data;

wherein the fourth switch element outputs the third select voltage as the second reference voltage on condition that the fourth switch element is enabled by the data of the first bit of the gamma correction data, disabled by the data of the second bit of the gamma correction data, and enabled by the data of a third bit of the gamma correction data; and wherein the reference voltage select circuit outputs at least the first and second reference voltages of the first to Kth reference voltages.

The reference voltage generation circuit may comprise:

first to fourth switch cells respectively including the first to fourth switch elements, wherein the first switch cell activates a disable signal to the second switch cell and activates an enable signal to the third switch cell when the first switch cell is enabled by the data of the first bit of the gamma correction data, and deactivates the disable signal to the second switch cell and deactivates the enable signal to the third switch cell when the first switch cell is disabled by the data of the first bit of the gamma correction data;

wherein the second switch cell outputs the second select voltage as the first reference voltage and activates the enable signal to the fourth switch cell on condition that the second switch cell is enabled by the data of the second bit of the gamma correction data and the disable signal from the first switch cell is inactive, otherwise the second switch cell deactivates the enable signal to the fourth switch cell;

wherein the third switch cell outputs the second select voltage as the second reference voltage and activates the disable signal to the fourth switch cell on condition that the third switch cell is enabled by the data of the second bit of the gamma correction data and the enable signal from the first switch cell is active, otherwise the third switch cell deactivates the disable signal to the fourth switch cell; and wherein the fourth switch cell outputs the third select voltage as the second reference voltage on condition that the fourth switch cell is enabled by the data of the third bit of the gamma correction data, the disable signal from the third switch cell is inactive, and the enable signal from the second switch cell is active.

In this reference voltage generation circuit, the reference voltage select circuit may include:

a first switch cell including a first switch element for outputting the first select voltage as the first reference voltage;

a second switch cell including a second switch element for outputting the second select voltage as the first reference voltage;

a third switch cell including a third switch element for outputting the second select voltage as the second reference voltage; and a fourth switch cell including a fourth switch element for outputting the third select voltage as the second reference voltage, wherein the first switch cell is provided with the data of the first bit of the gamma correction data and outputs an enable signal to the second and third switch cells wherein the second switch cell is provided with the data of the second bit of the gamma correction data and outputs the enable signal to the third and fourth switch cells;

wherein the third switch cell is provided with the data of the second bit of the gamma correction data and outputs the enable signal to the fourth switch cell;

wherein the fourth switch cell is provided with the data of the third bit of the gamma correction data; and wherein the reference voltage select circuit outputs at least the first and second reference voltages of the first to Kth reference voltages.

In addition to achieving the above-described effects, the reference voltage select circuit includes at least the first to fourth switch elements and makes it unnecessary to provide a switch element for outputting the first select voltage as the second reference voltage. Moreover, when outputting only the first and second reference voltages, a switch element for outputting the third select voltage as the first reference voltage can be omitted. Therefore, a reference voltage select circuit which can select the reference voltages for realizing highly accurate gamma correction by using a simple configuration can be provided.

According to one embodiment of the invention, there is provided a display driver which drives data lines of an electro-optical device, the display driver comprising:

the above-described reference voltage generation circuit;

a voltage select circuit which selects a reference voltage corresponding to grayscale data from the first to Kth reference voltages from the reference voltage generation circuit, and outputs the selected reference voltage as a data voltage; and a driver circuit which drives the data lines based on the data voltage.

This enables to provide a display driver including a reference voltage generation circuit which can easily implement different types of highly accurate gamma correction with low power consumption and simple configuration.

According to one embodiment of the invention, there is provided an electro-optical device comprising:

a plurality of scan lines;

a plurality of data lines;

a pixel electrode specified by one of the scan lines and one of the data lines;

a scan driver which scans the scan lines; and the above-described display driver which drives the data lines.

This enables to provide an electro-optical device which can easily implement different types of highly accurate gamma correction with low power consumption and simple configuration.

According to one embodiment of the invention, there is provided an electronic instrument comprising the above-described display driver.

According to one embodiment of the invention, there is provided an electronic instrument comprising the above-described electro-optical device.

This enables to provide an electronic instrument including a reference voltage generation circuit which can easily implement different types of highly accurate gamma correction with low power consumption and simple configuration.

These embodiments of the invention will be described in detail below, with reference to the drawings. Note that the embodiments described below do not in any way limit the scope of the invention laid out in the claims herein. In addition, not all of the elements of the embodiments described below should be taken as essential requirements of the invention.

1. Liquid Crystal Display Device

FIG. 1 shows an outline of a configuration of an active matrix type liquid crystal display device according to one embodiment of the invention. Note that a data driver (display driver) including a reference voltage select circuit according to one embodiment of the invention may be applied to a simple matrix type liquid crystal display device instead of an active matrix type liquid crystal display device described below.

A liquid crystal display device 10 includes an LCD panel (display panel in a broad sense; electro-optical device in a broader sense) 20. The LCD panel 20 is formed on a glass substrate, for example. A plurality of scan lines (gate lines) GL1 to GLM (M is an integer greater than one), arranged in a direction Y and extending in a direction X, and a plurality of data lines (source lines) DL1 to DLN (N is an integer greater than one), arranged in the direction X and extending in the direction Y, are disposed on the glass substrate. A pixel area (pixel) is provided corresponding to the intersecting point of the scan line GLm ($1 \leqq m \leqq M$, is an integer; hereinafter the same) and the data line DLn ($1 \leqq n \leqq N$, n is an integer; hereinafter the same). A thin film transistor (hereinafter abbreviated as "TFT") 22*mn* is disposed in the pixel area.

The gate of the TFT 22*mn* is connected with the scan line GLn. The source of the TFT 22*mn* is connected with the data line DLn. The drain of the TFT 22*mn* is connected with a pixel electrode 26*mn*. A liquid crystal is sealed between the pixel electrode 26*mn* and a common electrode 28*mn* opposite to the pixel electrode 26*mn* so that a liquid crystal capacitor 24*mn* (liquid crystal element in a broad sense) is formed. The transmissivity of the pixel changes corresponding to the voltage applied between the pixel electrode 26*mn* and the common electrode 28*mn*. A common electrode voltage Vcom is supplied to the common electrode 28*mn*.

The LCD panel 20 is formed by attaching a first substrate on which the pixel electrode and the TFT are formed to a second substrate on which the common electrode is formed, and sealing a liquid crystal as an electro-optical substance between the substrates, for example.

The liquid crystal display device 10 includes a data driver (display driver in a broad sense) 30. The data driver 30 drives the data lines DL1 to DLN of the LCD panel 20 based on grayscale data.

The liquid crystal display device 10 may include a gate driver (scan driver in a broad sense) 32. The gate driver 32 scans the scan lines GL1 to GLM of the LCD panel 20 within one vertical scan period.

The liquid crystal display device 10 may include a power supply circuit 100. The power supply circuit 100 generates voltages necessary for driving the data lines, and supplies the generated voltages to the data driver 30. The power supply circuit 100 generates power supply voltages VDDH and VSSH necessary for the data driver 30 to drive the data lines and voltages necessary for a logic section of the data driver 30, for example.

The power supply circuit 100 generates voltage necessary for driving (scanning) the scan lines, and supplies the generated voltage to the gate driver 32.

The power supply circuit 100 generates the common electrode voltage Vcom. The power supply circuit 100 outputs the common electrode voltage Vcom, which periodically changes between a high-potential-side voltage VCOMH and a low-potential-side voltage VCOML in synchronization with the timing of a polarity reversal signal POL generated by the data driver 30, to the common electrode of the LCD panel 20.

The liquid crystal display device 10 may include a display controller 38. The display controller 38 controls the data driver 30, the gate driver 32, and the power supply circuit 100 according to the content set by a host (not shown) such as a central processing unit (hereinafter abbreviated as "CPU"). For example, the display controller 38 sets the operation mode of the data driver 30 and the gate driver 32 and supplies a vertical synchronization signal and a horizontal synchronization signal generated therein to the data driver 30 and the gate driver 32. In one embodiment of the invention, gamma correction data is read from a nonvolatile memory provided outside the data driver 30 during initialization. However, the display controller 38 may supply gamma correction data to the data driver 30 to implement various types of gamma correction.

In FIG. 1, the liquid crystal display device 10 is configured to include the power supply circuit 100 and the display controller 38. However, at least one of the power supply circuit 100 and the display controller 38 may be provided outside the liquid crystal display device 10. Or, the liquid crystal display device 10 may be configured to include the host.

The data driver 30 may include at least one of the gate driver 32 and the power supply circuit 100.

Figure 2:
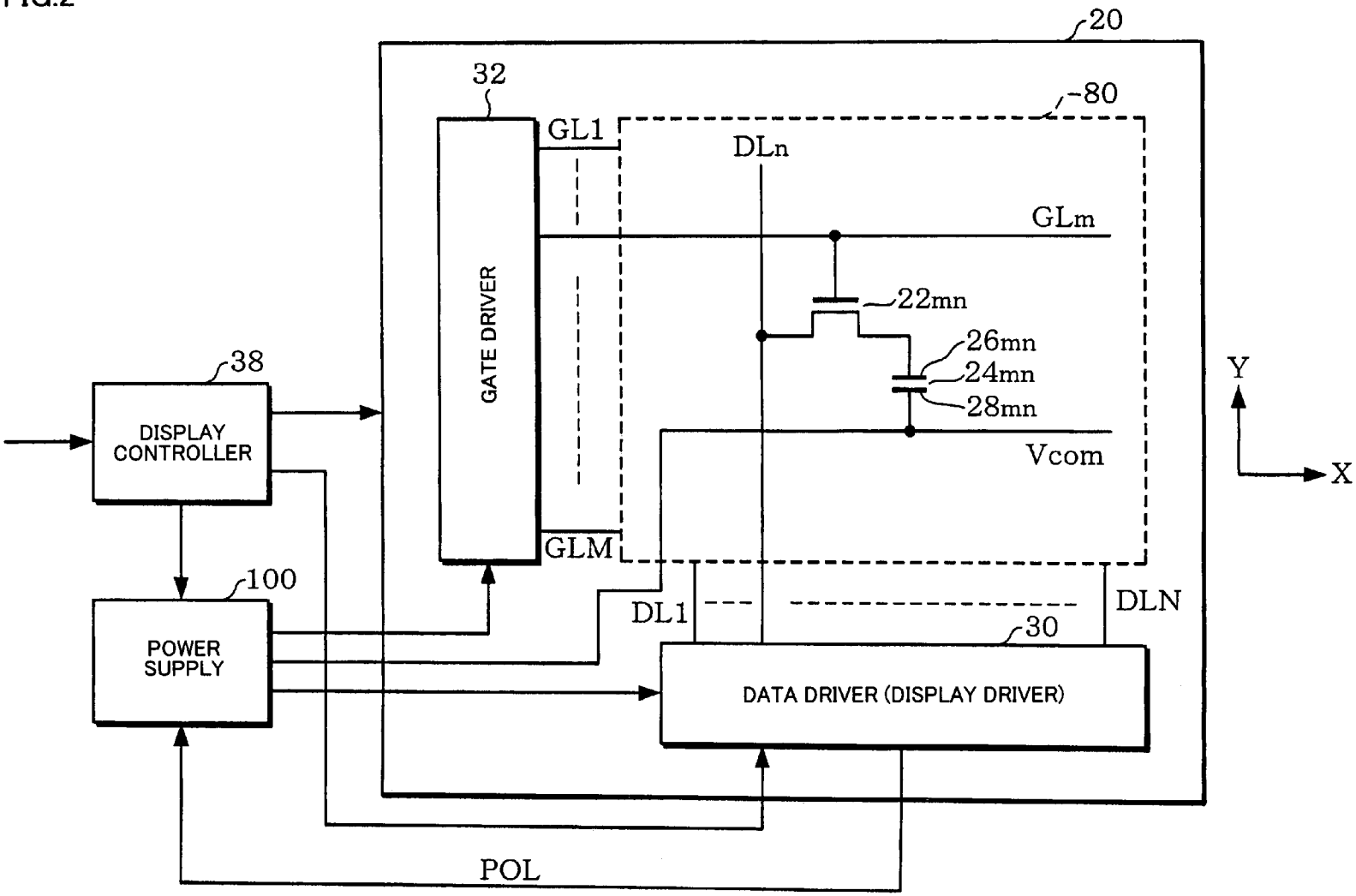
FIG. 2 is a diagram showing an outline of another configuration of a liquid crystal display device according to one embodiment of the invention.

Some or all of the data driver 30, the gate driver 32, the display controller 38, and the power supply circuit 100 may be formed on the LCD panel 20. In FIG. 2, the data driver 30 and the gate driver 32 are formed on the LCD panel 20. Specifically, the LCD panel 20 may be configured to include a plurality of data lines, a plurality of scan lines, a plurality of switch elements, each of which is connected with one of the scan lines and one of the data lines, and a display driver which drives the data lines. Pixels are formed in a pixel formation area 80 of the LCD panel 20.

2. Gate Driver

Figure 3:
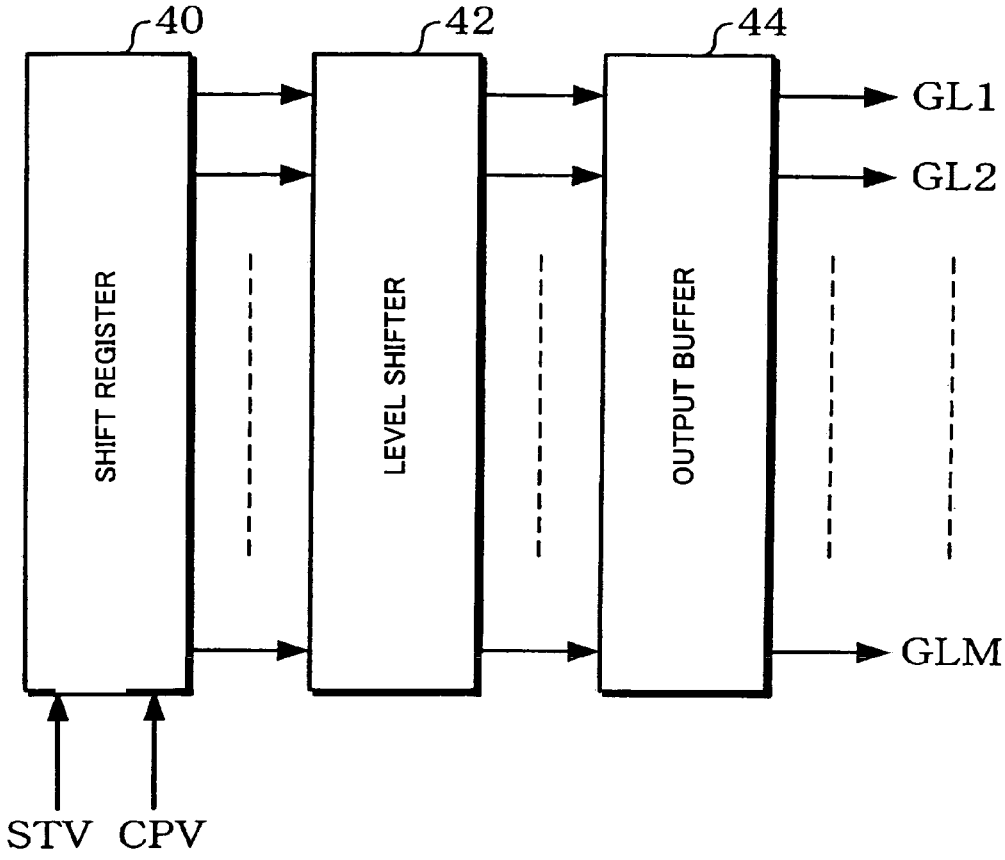
FIG. 3 is a diagram showing a configuration example of a gate driver shown in FIG. 1.

FIG. 3 shows a configuration example of the gate driver 32 shown in FIG. 1.

The gate driver 32 includes a shift register 40, a level shifter 42, and an output buffer 44.

The shift register 40 includes a plurality of flip-flops provided corresponding to the scan lines and connected in series. The shift register 40 holds a start pulse signal STV in the flip-flop in synchronization with a clock signal CPV, and sequentially shifts the start pulse signal STV to the adjacent flip-flops in synchronization with the clock signal CPV. The input clock signal CPV is a horizontal synchronization signal, and the start pulse signal STV is a vertical synchronization signal.

The level shifter 42 shifts the level of the voltage from the shift register 40 to the voltage level corresponding to the liquid crystal element of the LCD panel 20 and the transistor performance of the TFT. The voltage level needs to be as high 20 to 50 V, for example.

The output buffer 44 buffers the scan voltage shifted by the level shifter 42 and drives the scan line by outputting the scan voltage to the scan line.

3. Data Driver

Figure 4:
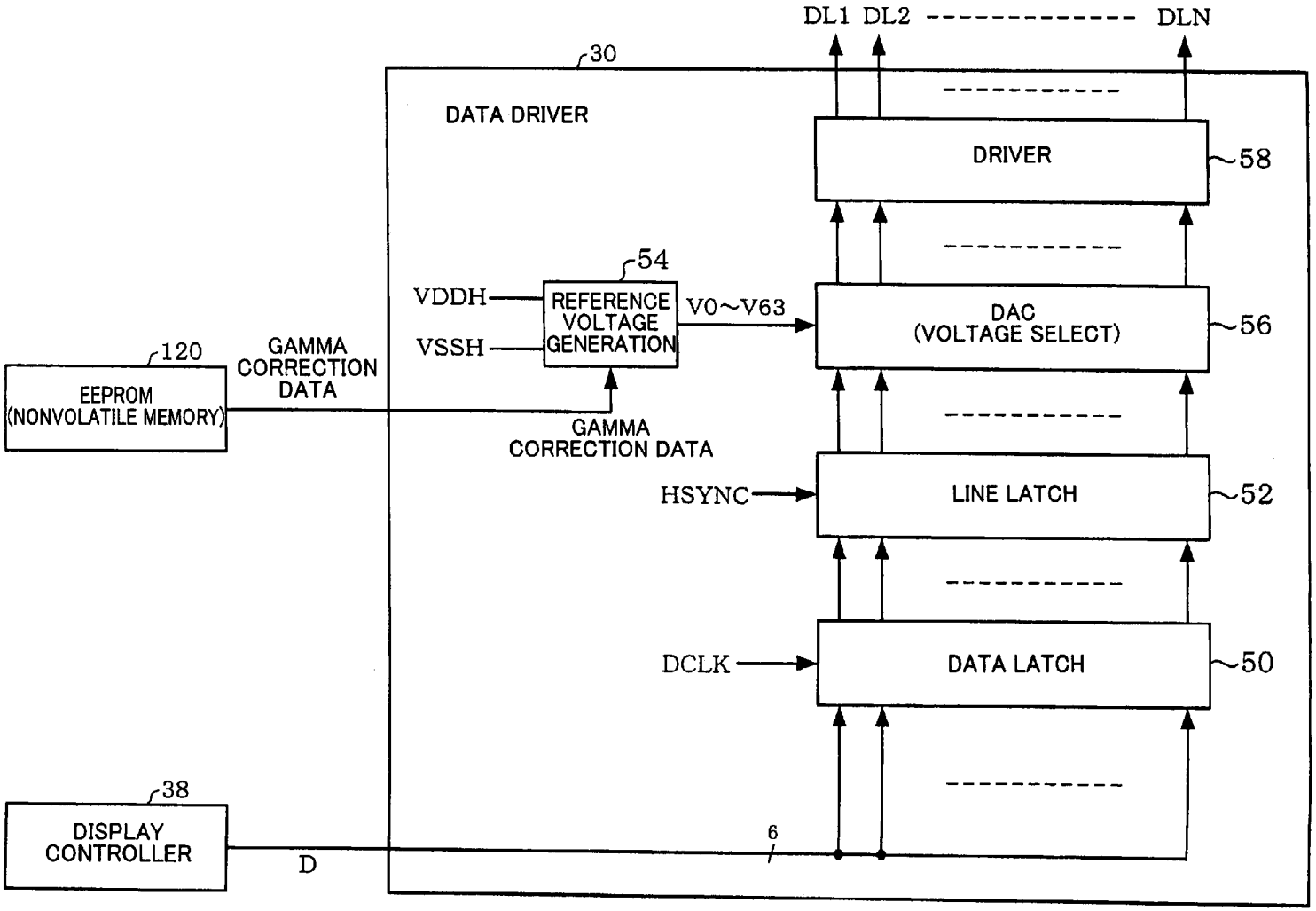
FIG. 4 is a block diagram of a configuration example of a data driver shown in FIG. 1.

FIG. 4 is a block diagram showing a configuration example of the data driver 30 shown in FIG 1. In FIG. 4, the number of bits of grayscale data per dot is six. However, the number of bits of grayscale data is not limited thereto.

The data driver 30 includes a data latch 50, a line latch 52, a reference voltage generation circuit 54, a digital/analog converter (DAC) (voltage select circuit in a broad sense) 56, and a driver circuit 58.

Grayscale data is serially input to the data driver 30 in pixel units (or dot units). The grayscale data is input in synchronization with a dot clock signal DCLK. The dot clock signal DCLK is supplied from the display controller 38. In FIG. 4, the grayscale data is input in dot units for convenience of description.

The data latch 50 shifts a capture start signal in synchronization with the dot clock signal DCLK, and latches the grayscale data in synchronization with the shift output to acquire the grayscale data for one horizontal scan, for example.

The line latch 52 latches the grayscale data for one horizontal scan latched by the data latch 50 at the change timing of a horizontal synchronization signal HSYNC.

The reference voltage generation circuit 54 generates a plurality of reference voltages, each of which respectively corresponds to the grayscale data. In more detail, the reference voltage generation circuit 54 generates first to Kth (K is an integer greater than one) reference voltages arranged in potential descending order or potential ascending order. In this case, the reference voltage generation circuit 54 generates first to Lth (L is an integer greater than K) select voltages arranged in potential descending order or potential ascending order, and outputs K select voltages selected from the first to Lth select voltages based on L-bit gamma correction data as the first to Kth reference voltages in potential descending order or potential ascending order. The data of each bit of the gamma correction data corresponds to one of the select voltages, and indicates whether or not to output the select voltage as the reference voltage.

In one embodiment of the invention, the reference voltage generation circuit 54 can output the first to Kth reference voltages selected from the first to Lth select voltages based on one of different types of gamma correction data.

The following description is given on the assumption that L is 256 and K is 64. In this case, the reference voltage generation circuit 54 generates reference voltages V0 to V63, each of which corresponds to 6-bit grayscale data, based on the high-potential-side power supply voltage VDDH and the low-potential-side power supply voltage VSSH.

The DAC 56 generates data voltages corresponding to the grayscale data output from the line latch 52 in output line units. In more detail, the DAC 56 selects the reference voltage corresponding to the grayscale data for one output line, which is output from the line latch 52, from the reference voltages V0 to V63 generated by the reference voltage generation circuit 54, and outputs the selected reference voltage as the data voltage.

The driver circuit 58 drives the output lines connected with the data lines of the LCD panel 20. In more detail, the driver circuit 58 drives the output line based on the data voltage generated by the DAC 56 in output line units. Specifically, the driver circuit 58 drives the data line based on the data voltage which is the reference voltage selected based on the grayscale data. The driver circuit 58 includes a voltage-follower-connected operational amplifier provided in output line units, and the operational amplifier drives the output line based on the data voltage from the DAC 56.

Figure 5:
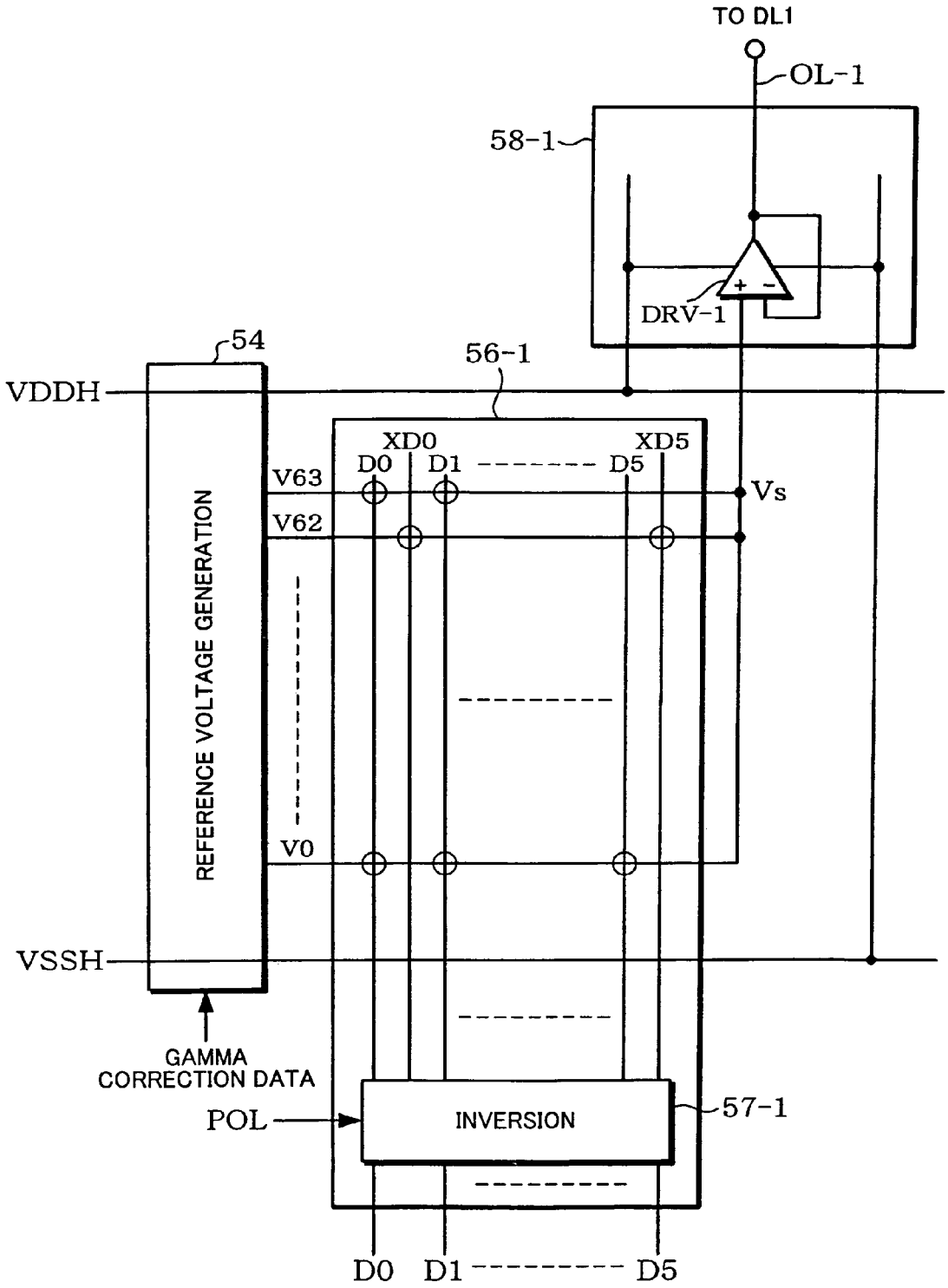
FIG. 5 is a diagram showing an outline of a configuration of a reference voltage generation circuit, a DAC, and a driver circuit shown in FIG. 4.

FIG. 5 shows an outline of a configuration of the reference voltage generation circuit 54, the DAC 56, and the driver circuit 58. FIG. 5 shows only the configuration of the driver circuit 58 which drives an output line OL-1 electrically connected with the data line DL1. However, the following description also applies to other output lines.

The reference voltage generation circuit 54 outputs voltages generated by dividing the voltage between the high-potential-side power supply voltage VDDH and the low-potential-side power supply voltage VSSH by using a resistor circuit as the reference voltages V0 to V63. In a polarity inversion drive, since the positive and negative voltages applied to the liquid crystal element are not symmetrical with respect to a predetermined potential, the reference voltages used in a positive drive period and the reference voltages used in a negative drive period are generated. FIG. 5 shows either the positive reference voltages or the negative reference voltages.

A DAC 56-1 may be realized by using a ROM decoder circuit. The DAC 56-1 selects one of the reference voltages V0 to V63 based on the 6-bit grayscale data, and outputs the selected reference voltage to an operational amplifier DRV-1 as a select voltage Vs. The voltages selected based on the corresponding 6-bit grayscale data are similarly output to other operational amplifiers DRV-2 to DRV-N.

The DAC 56-1 includes an inversion circuit 57-1. The inversion circuit 57-1 reverses the grayscale data based on the polarity reversal signal POL. 6-bit grayscale data D0 to D5 and 6-bit inversion grayscale data XD0 to XD5 are input to the DAC 56-1. The inversion grayscale data XD0 to XD5 is generated by reversing the grayscale data D0 to D5, respectively. The DAC 56-1 selects one of the multi-valued reference voltages V0 to V63 generated by the reference voltage generation circuit 54 based on the grayscale data.

When the logic level of the polarity reversal signal POL is "H", the reference voltage V2 is selected corresponding to the 6-bit grayscale data D0 to D5 set at "000010" (=2), for example. When the logic level of the polarity reversal signal POL is "L", the reference voltage is selected by using the inversion grayscale data XD0 to XD5 generated by reversing the grayscale data D0 to D5. Specifically, the inversion display data XD0 to XD5 is set at "111101" (=61) so that the reference voltage V61 is selected.

The select voltage Vs selected by the DAC 56-1 is supplied to the operational amplifier DRV-1.

The operational amplifier DRV-1 drives the output line OL-1 based on the select voltage Vs. The power supply circuit 100 changes the voltage of the common electrode in synchronization with the polarity reversal signal POL as described above. The polarity of the voltage applied to the liquid crystal is reversed in this manner.

In FIG. 4, the gamma correction data is stored in advance in an electrically erasable programmable read only memory (EEPROM) as a nonvolatile memory provided inside or outside of the data driver 30. The data stored in the EEPROM can be electrically rewritten. The data driver 30 reads the gamma correction data from an EEPROM 120 during predetermined initialization which starts after reset.

Figure 6:
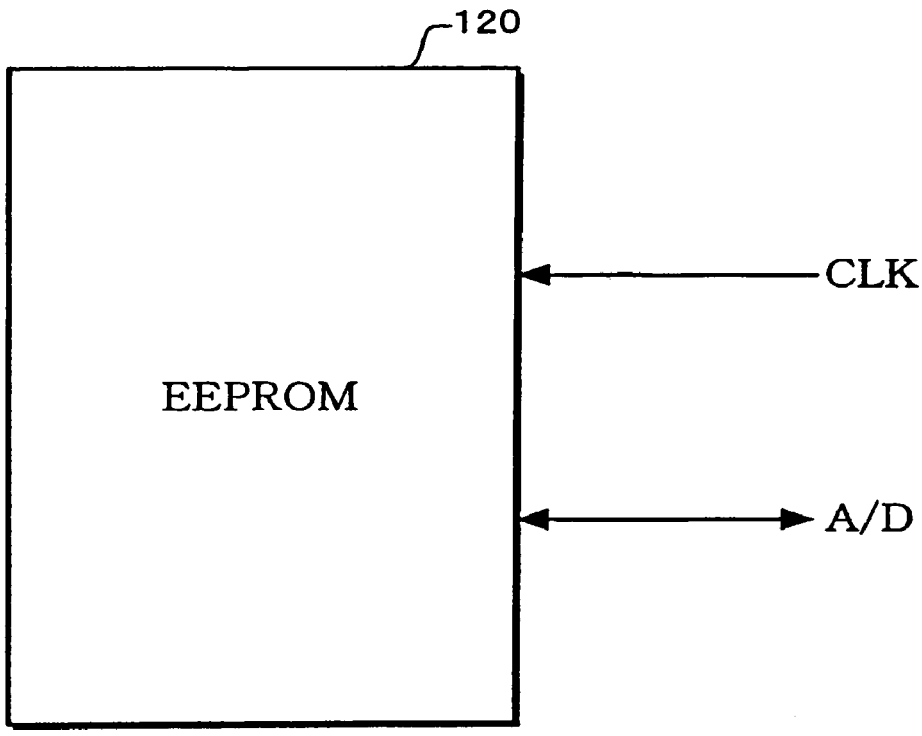
FIG. 6 is a diagram showing an outline of an EEPROM according to one embodiment of the invention.

FIG. 6 shows an outline of a configuration of the EEPROM 120.

An address/data division bus and a clock signal line are connected with the EEPROM 120. The address/data division bus and the clock signal line are connected with the data driver 30.

Figure 7:
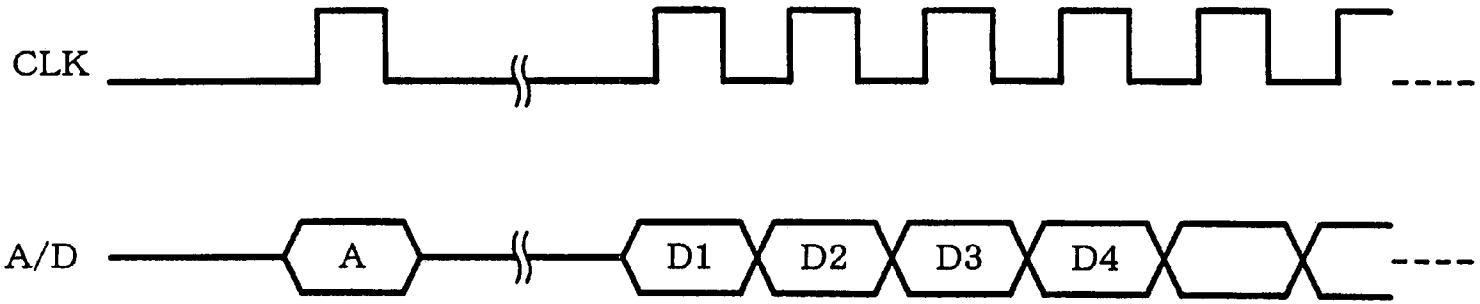
FIG. 7 is a timing diagram of a read control example of the EEPROM.

FIG. 7 is a timing diagram of a read control example of the EEPROM 120.

The data driver 30 sets address data A in the EEPROM 120 by outputting the address data A to the address/data division bus and outputting one clock pulse to the clock signal line, for example. The address data A indicates an address in a memory space of the EEPROM 120 in which control data (e.g. gamma correction data) read by the data driver 30 is stored.

The data driver 30 then sequentially supplies clock pulses to the clock signal line. The EEPROM 120 increments the stored address data A in synchronization with the clock signal. The stored data (control data) corresponding to the address data A is output to the address/data division bus in synchronization with the clock signal on the clock signal line.

In one embodiment of the invention, the data driver 30 reads the gamma correction data from the EEPROM 120 during initialization as described with reference to FIG. 7, and sets the gamma correction data in one of gamma correction data registers included in the reference voltage generation circuit 54.

4. Reference Voltage Generation Circuit

Figure 8:
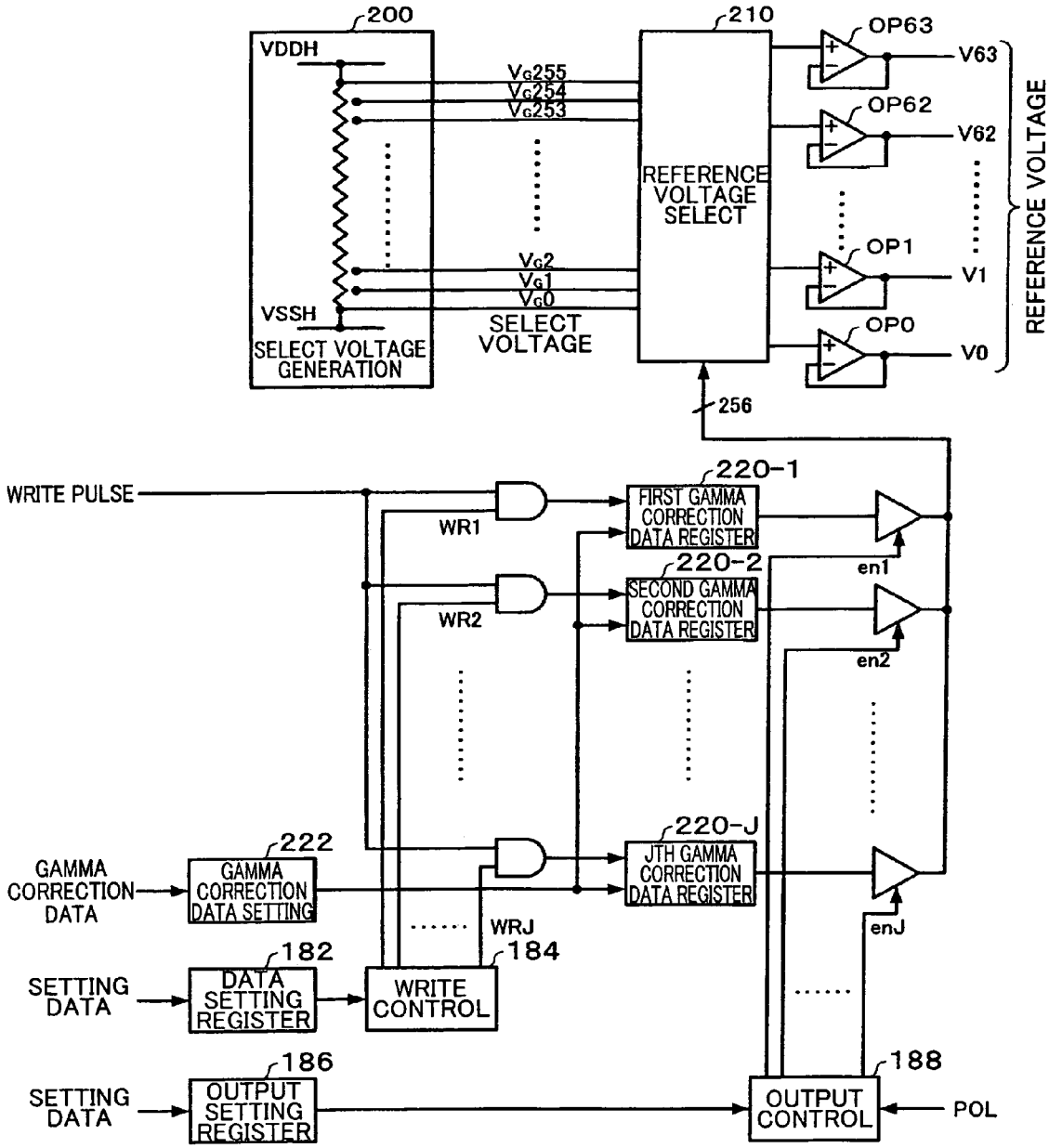
FIG. 8 is a block diagram of a configuration example of a reference voltage generation circuit according to one embodiment of the invention.

FIG. 8 is a block diagram of a configuration example of the reference voltage generation circuit 54 according to one embodiment of the invention.

The reference voltage generation circuit 54 includes a select voltage generation circuit 200, a reference voltage select circuit 210, and first to Jth (J is an integer greater than one) gamma correction data setting circuits 220-1 to 220-J.

The select voltage generation circuit 200 includes a ladder resistor circuit to which the high-potential-side power supply voltage VDDH and the low-potential-side power supply voltage VSSH are supplied at either end. The ladder resistor circuit includes a plurality of resistor elements connected in series. The select voltage is output from an output node at which the resistor elements are electrically connected. It is preferable that the resistance of each resistor element be changed by control from the host or the display controller 38.

The select voltage generation circuit 200 thus outputs the select voltages $V_G$0 to $V_G$255 arranged in potential ascending order. The select voltage generation circuit 200 may output the select voltages $V_G$0 to $V_G$255 arranged in potential descending order.

The L-bit gamma correction data is set in each of the first to Jth gamma correction data registers 220-1 to 220-J, the data of each bit of the gamma correction data being associated with one of the select voltages and indicating whether or not to output the select voltage as the reference voltage.

Figure 9:
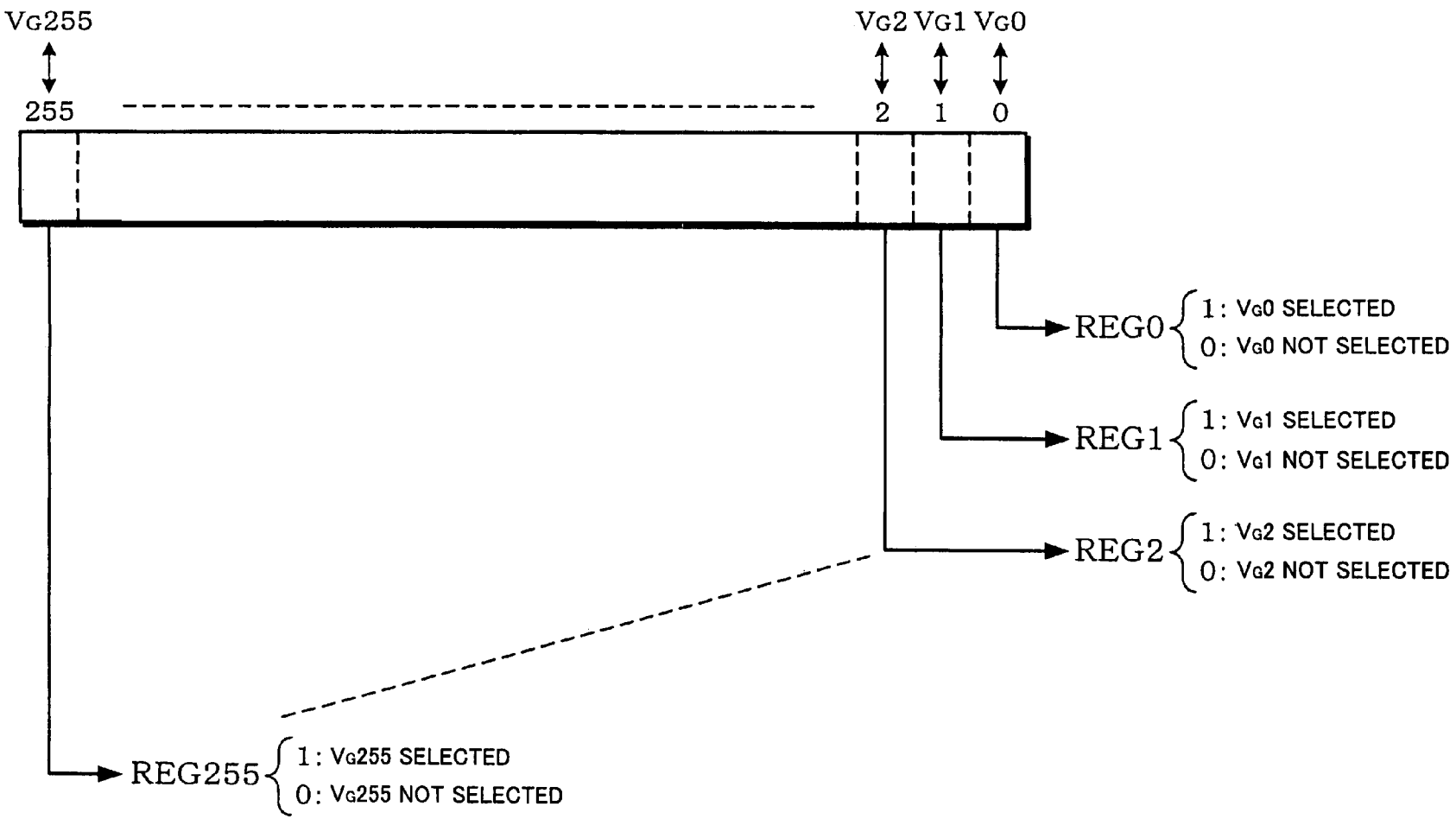
FIG. 9 is a diagram illustrative of gamma correction data according to one embodiment of the invention.

FIG. 9 is a diagram illustrative of the gamma correction data according to one embodiment of the invention.

When the number of select voltages is L, the gamma correction data has an L-bit configuration. Therefore, the gamma correction data shown in FIG. 8 has a 256-bit configuration. The data of each bit of the gamma correction data indicates whether or not to output the corresponding select voltage as the reference voltage. In one embodiment of the invention, the data of a bit set at "1" indicates that the select voltage corresponding to the bit is output as the reference voltage, and the data of a bit set at "0" indicates that the select voltage corresponding to the bit is not output as the reference voltage. Therefore, in the gamma correction data having a 256-bit configuration, only the data of arbitrary 64 bits of the 256 bits is set at "1", and the remaining data is set at "0".

In FIG. 9, the data of the 255th bit (most significant bit) of the gamma correction data is REG255, and the data of the 0th bit (least significant bit) of the gamma correction data is REG0.

In FIG. 8, the gamma correction data setting circuit 222 converts the gamma correction data serially input in bit units into parallel data having an 8-bit configuration, and sets the parallel data in one of the first to Jth gamma correction data registers 220-1 to 220-J. Therefore, it suffices to set the parallel data 32 times in the gamma correction data register when the gamma correction data has a 256-bit configuration. Therefore, it suffices to write the gamma correction data into each of the first to Jth gamma correction data registers 220 at low speed in synchronization with 32 write pulses instead of writing the gamma correction data into each gamma correction data register at high speed in synchronization with 256 write pulses, for example. This significantly reduces power consumption required when setting the gamma correction data.

Figure 10:
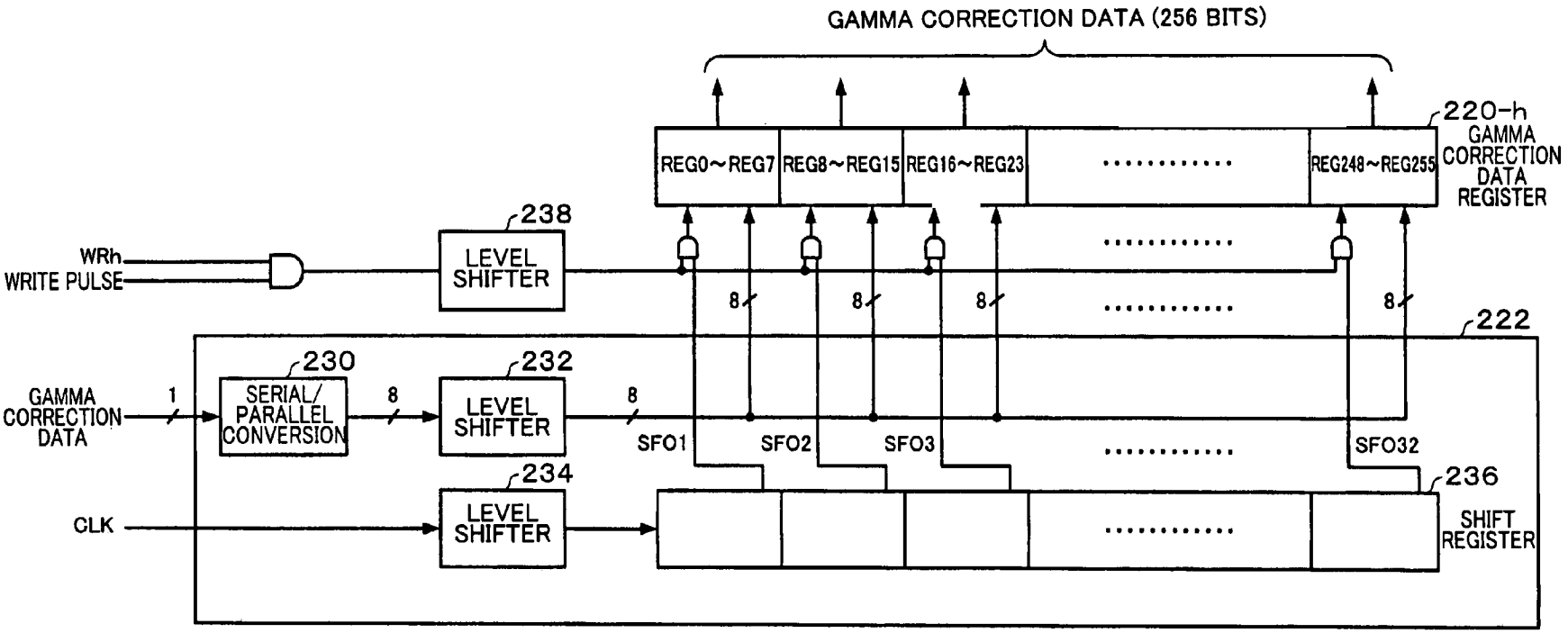
FIG. 10 is a diagram showing a configuration example of an h-th gamma correction data register and a gamma correction data setting circuit.

FIG. 10 shows a configuration example of the h-th ($1 \leqq h \leqq J$; h is an integer) gamma correction data register 220-*h* and the gamma correction data setting circuit 222.

FIG. 10 shows a configuration example for writing the gamma correction data into the h-th gamma correction data register 220-*h*. However, the following description also applies to other gamma correction data registers.

The gamma correction data setting circuit 222 may include a serial/parallel conversion circuit 230, level shifters 232 and 234, and a shift register 236.

The serial/parallel conversion circuit 230 converts the gamma correction data serially input in bit units into 8-bit parallel data. The level shifter 232 converts the signal level of each bit of the parallel data. Specifically, the level shifter 232 converts the signal level of each bit of the parallel data which oscillates between the low-amplitude logic power supply voltage so that the signal level of each bit of the parallel data oscillates between the high-amplitude liquid crystal drive power supply voltage.

The shift register 236 includes a plurality of flip-flops connected in series, and performs a shift operation in synchronization with a clock signal CLK as an input synchronization clock signal for the data of each bit of the gamma correction data to output shift outputs SFO1, SFO2, . . . , SFO32 in eight bit units. Therefore, the shift register 236 includes 256 flip-flops connected in series. The shift register 236 shifts a given start pulse in synchronization with the clock signal CLK. In FIG. 10, the clock signal CLK is input to the shift register 236 after the level shifter 234 has converted the signal level of the clock signal CLK.

The level shifter 238 shown in FIG. 10 converts the signal level of the AND result of a write pulse and a write enable signal WRh. The AND result signal of which the signal level has been converted is mask-controlled by using the shift outputs SFO1, SFO2, . . . , SFO32. The output of the level shifter 232 is set in the gamma correction data register 220 in eight bit units by using the mask-controlled signals.

Figure 11:
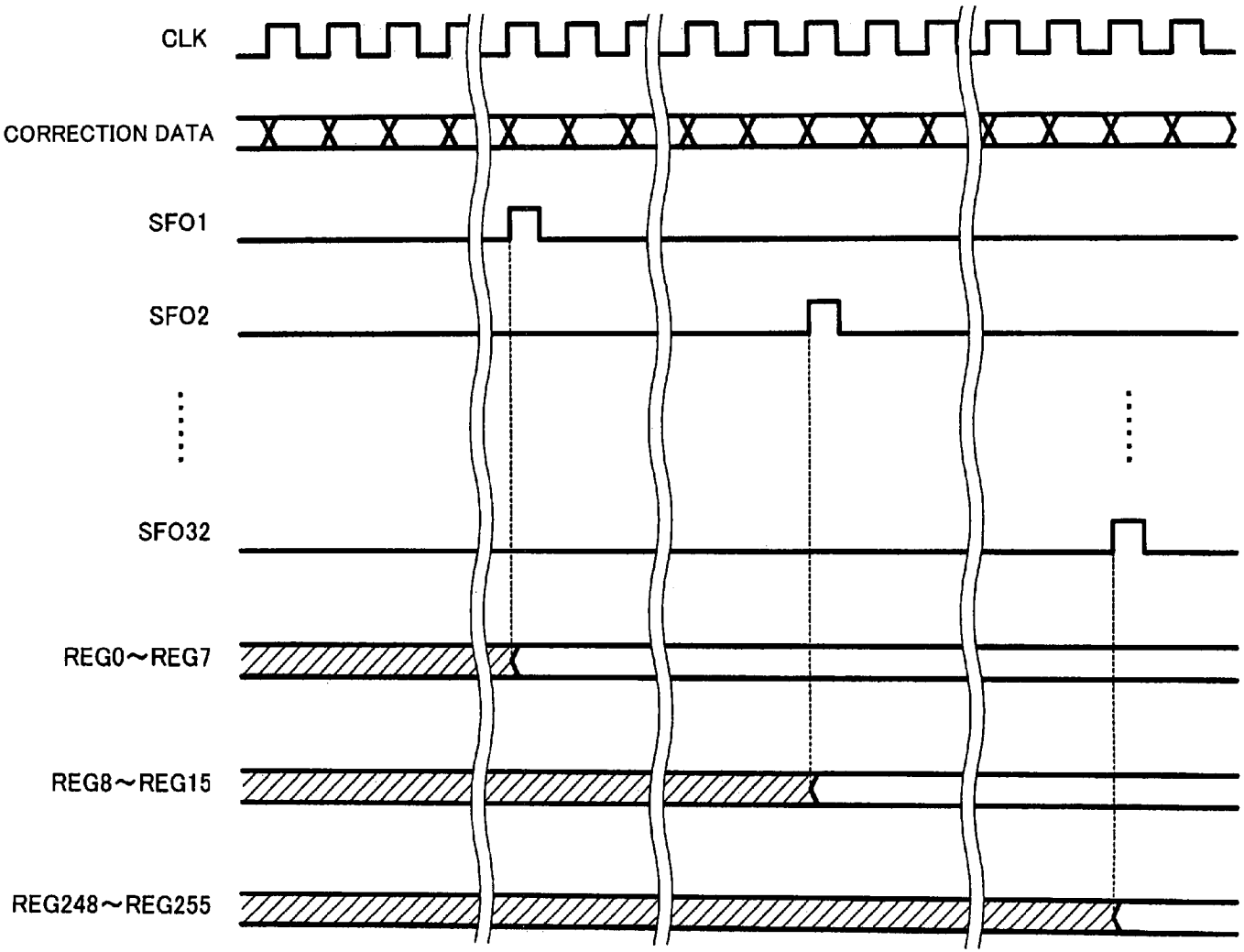
FIG. 11 is a timing diagram of an operation example of the gamma correction data setting circuit shown in FIG. 10.

FIG. 11 is a timing diagram of an operation example of the gamma correction data setting circuit 222 shown in FIG. 10.

Specifically, the serially input gamma correction data is converted into 8-bit parallel data. The shift output is output in units of eight bits of the gamma correction data, and set in the gamma correction data register 220 in eight bit units.

In one embodiment of the invention, the gamma correction data converted into the parallel data by the gamma correction data setting circuit 222 is set in one of the first to Jth gamma correction data registers 220-1 to 220-J. Therefore, it is preferable that the reference voltage generation circuit 54 include a data setting register 182 and a write control circuit 184.

Setting data which designates one of the first to Jth gamma correction data registers 220-1 to 220-J in which the gamma correction data (parallel data) is set is set in the data setting register 182 by the host or the display controller 38. The write control circuit 184 decodes the value set in the data setting register 182. The write control circuit 184 activates the write enable signal (WR1 to WRJ) of one of the first to Jth gamma correction data registers 220-1 to 220-J corresponding to the decode result of the value set in the data setting register 182. In FIG. 10, writing of the gamma correction data is controlled by using the write enable signal WRh of the h-th gamma correction data register 220-*h*.

The gamma correction data of which the signal level has been converted by the level shifter 232 is thus set in one of the first to Jth gamma correction data registers 220-1 to 220-J corresponding to the value set in the data setting register 182.

In FIG. 8, the reference voltage select circuit 210 outputs 64 (=K) select voltages selected from the select voltages $V_G$0 to $V_G$255 based on the gamma correction data set in one of the first to Jth gamma correction data registers 220-1 to 220-J as the reference voltages V0 to V63 (first to Kth reference voltages) in potential ascending order. The reference voltage select circuit 210 may output the reference voltages V0 to V63 arranged in potential descending order.

It is preferable that the reference voltage generation circuit 54 include first to Kth impedance conversion circuits to which the first to Kth reference voltages are respectively supplied at an input of each impedance conversion circuit. Specifically, it is preferable that the reference voltage generation circuit 54 include impedance conversion circuits OP0, OP1, . . . , OP63 to which the output of the reference voltage select circuit 210 is supplied at an input. The impedance conversion circuit is formed by using a voltage-follower-connected operational amplifier, for example. Therefore, the reference voltages are subjected to impedance conversion by the impedance conversion circuits OP0 to OP63 and supplied to the DAC 56. Therefore, it is possible to prevent an increase in the charging time of each signal line due to an increase in impedance from the signal line to which the high-potential-side or low-potential-side power supply voltage of the select voltage generation circuit is supplied to the reference voltage select circuit 210 and the DAC 56.

The gamma correction data is supplied to the reference voltage select circuit 210 according to one embodiment of the invention from one of the first to Jth gamma correction data registers 220-1 to 220-J. Therefore, it is preferable that the reference voltage generation circuit 54 include an output setting register 186 and an output control circuit 188.

Setting data which designates one of the first to Jth gamma correction data registers 220-1 to 220-J from which the gamma correction data is output is set in the output setting register 186 by the host or the display controller 38. The output control circuit 188 decodes the value set in the output setting register 186. The output control circuit 188 activates an gamma correction data output enable signal (en1 to enJ) of one of the first to Jth gamma correction data registers 220-1 to 220-J corresponding to the decode result of the value set in the output setting register 186. In FIG. 8, each of the output enable signals en1 to enJ is supplied as an output enable signal of an output buffer of the gamma correction data register, for example.

The gamma correction data output from one of the gamma correction data registers 220-1 to 220-J corresponding to the value set in the output setting register 186 is supplied to the reference voltage select circuit 210.

FIG. 12 is a diagram illustrative of an operation example of the reference voltage select circuit 210 shown in FIG. 8.

In FIG 12, the least significant bit of the gamma correction data is set at "0", the second lowest bit is set at "1", the third lowest bit is set at "1", and the most significant bit is set at "1". Since the least significant bit of the gamma correction data is set at "0", the select voltage $V_G$0 corresponding to the least significant bit is not output as the reference voltage.

On the other hand, since the second lowest bit of the gamma correction data is set at "1", the select voltage $V_G$1 corresponding to the second lowest bit is output as the reference voltage. Therefore, the select voltage $V_G$1 is output as the reference voltage V0.

Since the third lowest bit of the gamma correction data is set at "1", the select voltage $V_G$2 corresponding to the third lowest bit is output as the reference voltage. Therefore, the select voltage $V_G$2 is output as the reference voltage V1.

Likewise, since the second highest bit of the gamma correction data is set at "0", the select voltage $V_G$254 corresponding to the second highest bit is not output as the reference voltage. On the other hand, since the most significant bit of the gamma correction data is set at "1", the select voltage $V_G$255 corresponding to the most significant bit is output as the reference voltage. Therefore, the select voltage $VG^2$55 is output as the reference voltage V63.

This allows the reference voltage generation circuit 54 to generate the K select voltages selected from the first to Lth select voltages arranged in potential descending order or potential ascending order as the first to Kth reference voltages arranged in potential descending order or potential ascending order.

Figure 13:
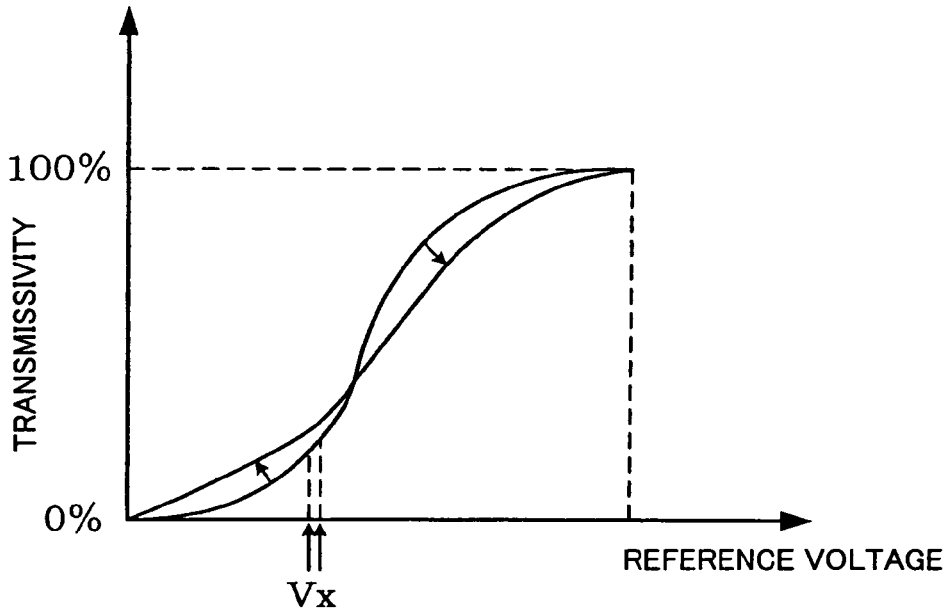
FIG. 13 is diagram illustrative of gamma characteristics.

FIG. 13 is a diagram illustrative of gamma characteristics.

In FIG. 13, the horizontal axis indicates the reference voltage, and the vertical axis indicates the pixel transmissivity. As described above, according to one embodiment of the invention, the voltage level of the reference voltage Vx can be selected from the select voltages so that a plurality of voltage levels can be output. Therefore, fine gamma correction corresponding to the type of LCD panel can be realized.

Moreover, the voltage levels of the reference voltages V0 to V63 output from the reference voltage generation circuit 54 can be diversified by enabling variable control of the resistance of each resistor element of the ladder resistor circuit of the select voltage generation circuit 200.

For example, the voltage level of the reference voltage to be corrected by gamma correction may differ depending on whether the LCD panel is a reflective type or a transparent type, or different colors may be preferred depending on the region in which the LCD panel is used. According to one embodiment of the invention, gamma correction corresponding to the panel type or regional preference can be easily realized by setting different types of gamma correction data in the gamma correction data registers by using the data setting register 182 and outputting the gamma correction data from a desired gamma correction data register by using the output setting register 186.

In one embodiment of the invention, the output control circuit 188 may activate one of the output enable signals en1 to enJ based on the polarity reversal signal POL. For example, one of the output enable signals en1 to enJ predetermined for a positive drive period is activated in a positive drive period determined based on the polarity reversal signal POL, and one of the output enable signals en1 to enJ predetermined for a negative drive period is activated in a negative drive period determined based on the polarity reversal signal POL. This allows the gamma correction data register selected from the first to Jth gamma correction data registers 220-1 to 220-J in the positive drive period to differ from the gamma correction data register selected from the first to Jth gamma correction data registers 220-1 to 220-J in the negative drive period when changing the voltage levels of the reference voltages in a given polarity inversion cycle by using the polarity inversion drive method. As a result, optimum gamma correction can be easily realized for each polarity of the polarity inversion drive.

4.1 Reference Voltage Select Circuit

The reference voltage select circuit 210 according to one embodiment of the invention is described below.

The reference voltage select circuit 210 outputs L select voltages selected from the K select voltages arranged in potential descending order or potential ascending order as the L reference voltages arranged in potential descending order or potential ascending order. Therefore, when implementing the function of the reference voltage select circuit 210 merely by using a circuit, the circuit scale is increased.

Figure 14:
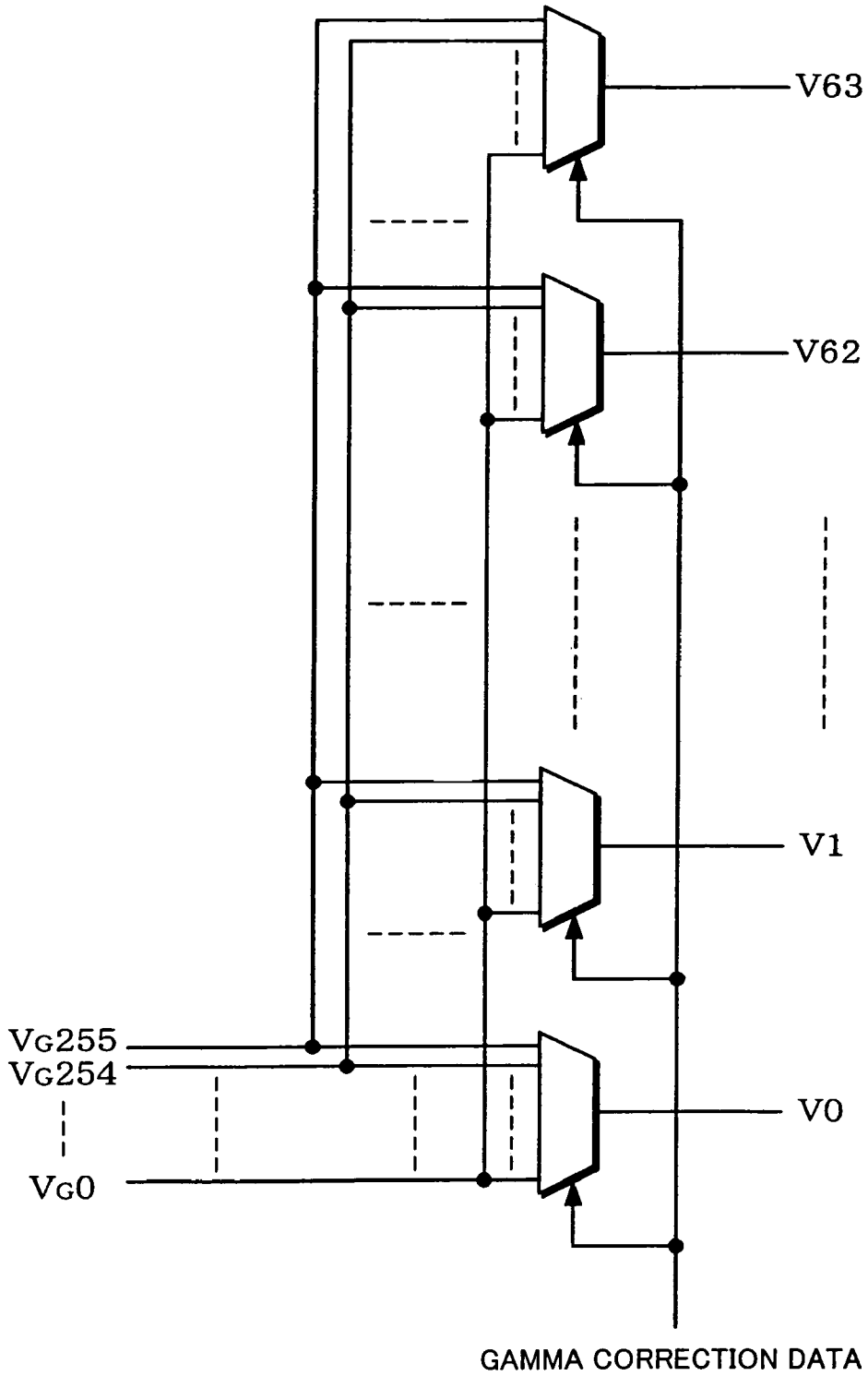
FIG. 14 is a block diagram of a configuration example of a reference voltage select circuit in a comparative example of one embodiment of the invention.

FIG. 14 is a block diagram of a configuration example of a reference voltage select circuit in a comparative example of one embodiment of the invention.

In the comparative example, 256-input one-output selectors are provided in reference voltage units. In this case, each selector selects one of the select voltages $V_G$0 to $V_G$255 based on the gamma correction data.

Therefore, since it is necessary to add a 256-input one-output selector when the number of reference voltages is increased, the circuit scale of not only the reference voltage select circuit but also the reference voltage generation circuit 54 is increased, so that power consumption is increased.

In one embodiment of the invention, the function of the reference voltage select circuit is realized by using a switch matrix configuration as described below. This prevents an increase in the circuit scale of the reference voltage select circuit 210. Moreover, even if the number of select voltages and the number of reference voltages are increased, an increase in the circuit scale of the reference voltage select circuit 210 is reduced in comparison with the comparative example.

Figure 15:
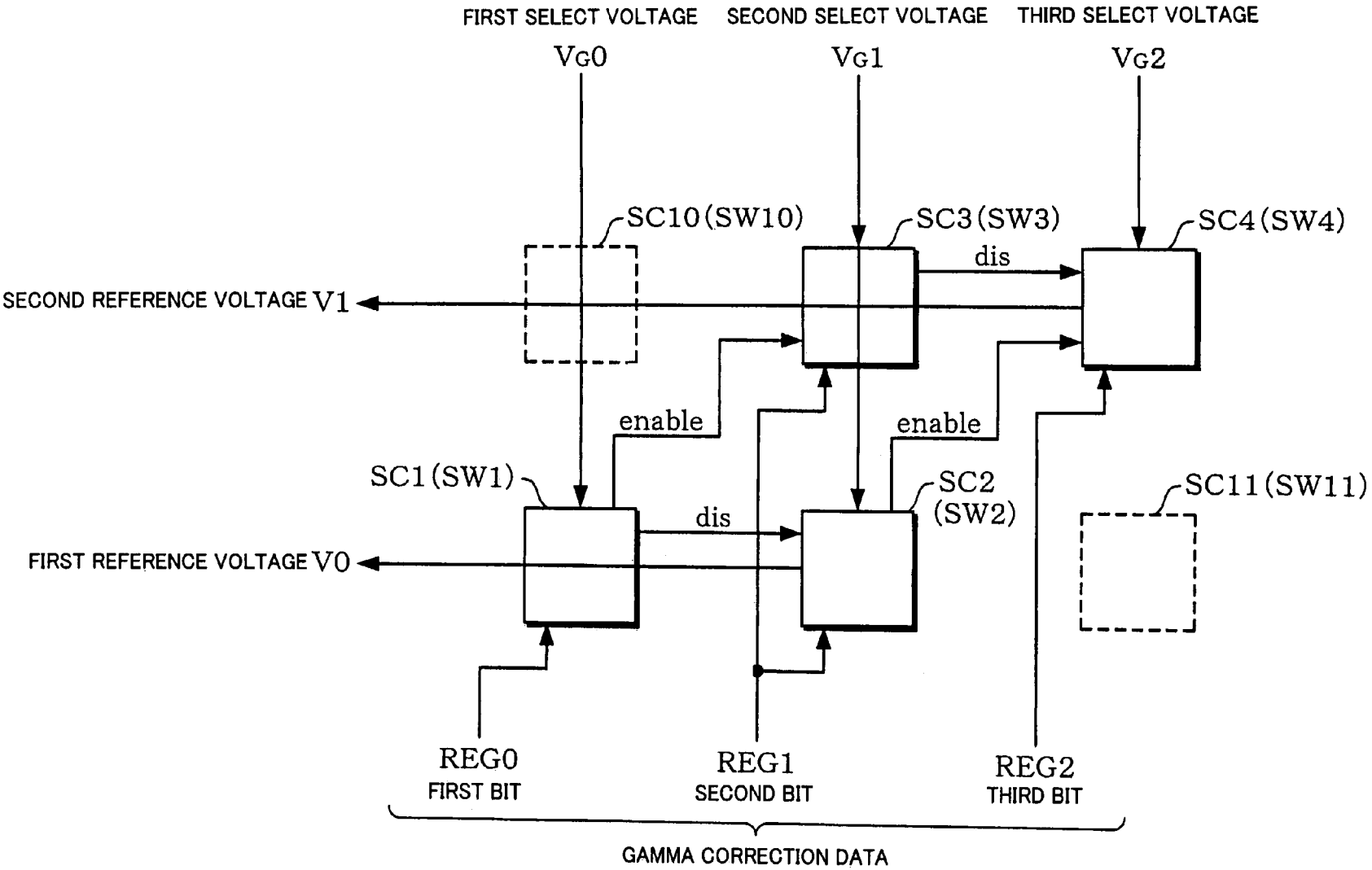
FIG. 15 is a block diagram of a configuration example of a reference voltage select circuit according to one embodiment of the invention.

FIG. 15 is a block diagram showing a configuration example of the reference voltage select circuit 210 according to one embodiment of the invention. FIG. 11 shows an example in which the number of select voltages is three ($V_G$0, $V_G$1, $V_G$2) and the number of reference voltages is two (V0, V1) for convenience of illustration. The reference voltage select circuit 210 in which the number of select voltages is three or more and the number of reference voltages is two or more necessarily includes the configuration shown in FIG. 15. Therefore, the reference voltage generation circuit 54 according to one embodiment of the invention which generates the first to Kth reference voltages arranged in potential descending order or potential ascending order may include a reference voltage select circuit which outputs at least the first and second reference voltages of the first to Kth reference voltages as shown in FIG. 15.

The reference voltage select circuit shown in FIG. 15 selects the first and second reference voltages V0 and V1 arranged in potential descending order or potential ascending order from the first to third select voltages $V_G$0 to $V_G$2 arranged in potential descending order or potential ascending order based on the 3-bit gamma correction data.

The reference voltage select circuit includes first to fourth switch elements SW1 to SW4. The first switch element SW1 is a switch circuit for outputting the first select voltage $V_G$0 as the first reference voltage V0. The second switch element SW2 is a switch circuit for outputting the second select voltage $V_G$1 as the first reference voltage V0. The third switch element SW3 is a switch circuit for outputting the second select voltage $V_G$1 as the second reference voltage V1. The fourth switch element SW4 is a switch circuit for outputting the third select voltage $V_G$2 as the second reference voltage V1. The switch circuit electrically connects or disconnects the signal line to which the select voltage is supplied and the signal line to which the reference voltage is output.

The first switch element SW1 outputs the first select voltage $V_G$0 as the first reference voltage V0 on condition that the first switch element SW1 is enabled by the data REG0 of the first bit of the gamma correction data. The second switch element SW2 outputs the second select voltage $V_G$1 as the first reference voltage V0 on condition that the second switch element SW2 is disabled by the data REG0 of the first bit of the gamma correction data and enabled by the data REG1 of the second bit of the gamma correction data. The third switch element SW3 outputs the second select voltage $V_G$1 as the second reference voltage V1 on condition that the third switch element SW3 is enabled by the data REG0 of the first bit of the gamma correction data and enabled by the data REG1 of the second bit of the gamma correction data. The fourth switch element SW4 outputs the third select voltage $V_G$2 as the second reference voltage V1 on condition that the fourth switch element SW4 is enabled by the data REG0 of the first bit of the gamma correction data, disabled by the data REG1 of the second bit of the gamma correction data, and enabled by the data REG2 of the third bit of the gamma correction data.

The reference voltage select circuit shown in FIG. 15 may include first to fourth switch cells SC1 to SC4 respectively including the first to fourth switch elements SW1 to SW4. Each switch cell ON/OFF-controls the switch element provided therein based on the enable signal and the disable signal supplied from other switch cells, and outputs the enable signal and the disable signal to other switch cells.

Figure 16A:
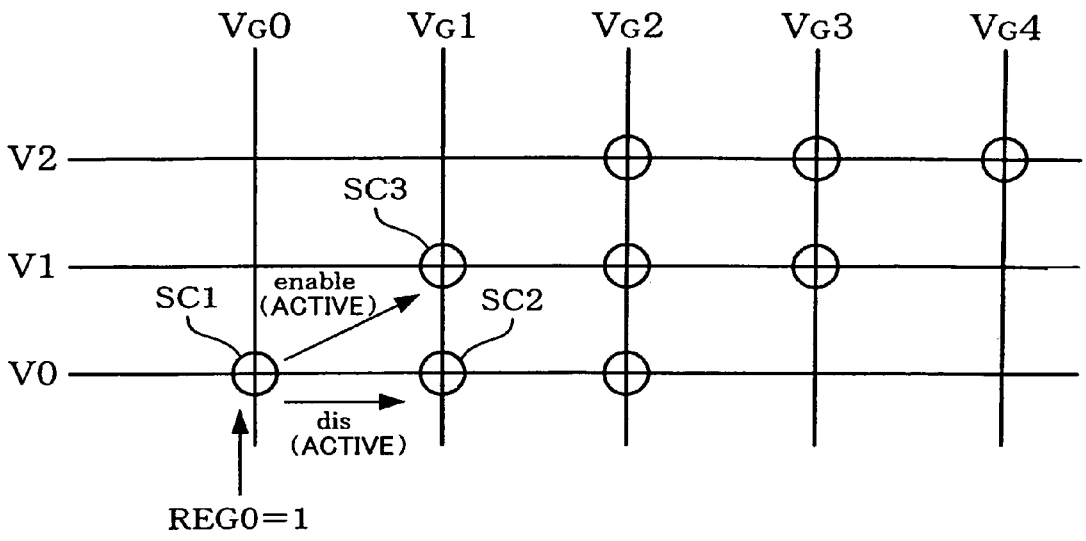
FIGS. 16A and 16B are diagrams illustrative of an enable signal and a disable signal output from one switch cell to other switch cells.
Figure 16B:
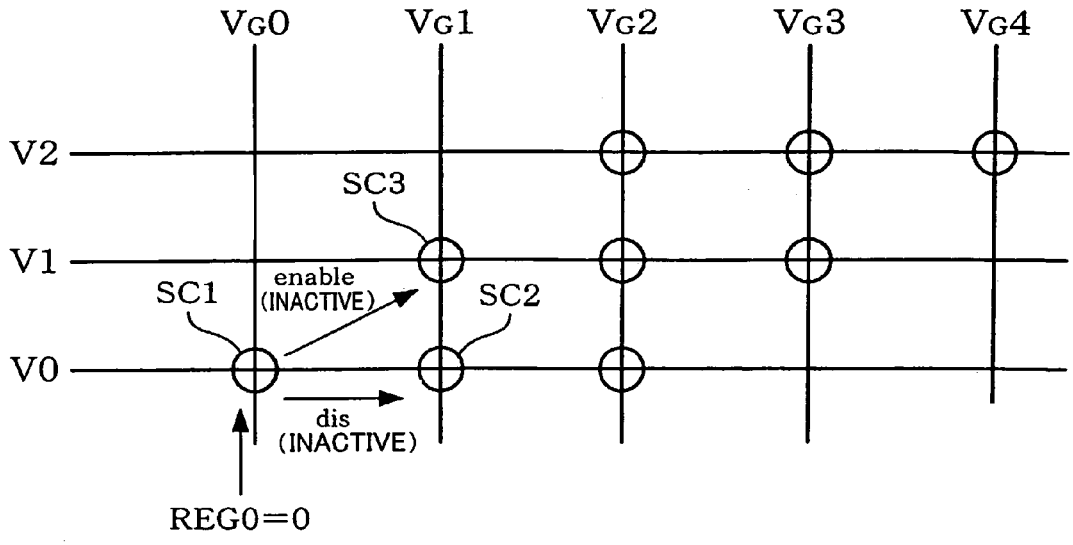

FIGS. 16A and 16B are diagrams illustrative of the enable signal and the disable signal output from one switch cell to other switch cells. FIGS. 16A and 16B show an example in which three reference voltages are selected from four select voltages.

In FIG. 16A, when the first switch cell SC1 is enabled by the data REG0 of the first bit of the gamma correction data, the first switch cell SC1 activates the disable signal "dis" to the second switch cell SC2 and activates the enable signal "enable" to the third switch cell, for example.

The second switch cell SC2 ON/OFF-controls the second switch element SW2 included in the second switch cell SC2 by using the disable signal "dis" from the first switch cell SC1. Likewise, the third switch cell SC3 ON/OFF-controls the third switch element SW3 included in the third switch cell SC3 by using the enable signal "enable" from the first switch cell SC1.

In FIG. 16B, when the first switch cell SC1 is disabled by the data REG0 of the first bit of the gamma correction data, the first switch cell SC1 deactivates the disable signal "dis" to the second switch cell SC2 and deactivates the enable signal "enable" to the third switch cell SC3, for example.

In this case, the second switch cell SC2 ON/OFF-controls the second switch element SW2 included in the second switch cell SC2 by using the disable signal "dis" from the first switch cell SC1 in the same manner as in FIG. 16A. The third switch cell SC3 ON/OFF-controls the third switch element SW3 included in the third switch cell SC3 by using the enable signal "enable" from the first switch cell SC1.

In more detail, when the first switch cell SC1 is enabled by the data REG0 of the first bit of the gamma correction data, the first switch cell SC1 activates the disable signal "dis" to the second switch cell SC2 and activates the enable signal "enable" to the third switch cell SC3. When the first switch cell SC1 is disabled by the data REG0 of the first bit of the gamma correction data, the first switch cell SC1 deactivates the disable signal "dis" to the second switch cell SC2 and deactivates the enable signal "enable" to the third switch cell SC3.

The second switch cell SC2 outputs the second select voltage $V_G$1 as the first reference voltage V0 and activates the enable signal "enable" to the fourth switch cell SC4 on condition that the second switch cell SC2 is enabled by the data REG1 of the second bit of the gamma correction data and the disable signal "dis" from the first switch cell SC1 is inactive. Otherwise the second switch cell SC2 deactivates the enable signal "enable" to the fourth switch cell SC4.

The third switch cell SC3 outputs the second select voltage $V_G$1 as the second reference voltage V1 and activates the disable signal "dis" to the fourth switch cell SC4 on condition that the third switch cell SC3 is enabled by the data REG1 of the second bit of the gamma correction data and the enable signal "enable" from the first switch cell SC1 is active. Otherwise the third switch cell SC3 deactivates the disable signal "dis" to the fourth switch cell SC4.

The fourth switch cell SC4 outputs the third select voltage $V_G$2 as the second reference voltage V1 on condition that the fourth switch cell SC4 is enabled by the data REG2 of the third bit of the gamma correction data, the disable signal "dis" from the third switch cell SC3 is inactive, and the enable signal "enable" from the second switch cell SC2 is active.

It suffices to connect similar switch cells by propagating the enable signal and the disable signal as described above, so that the design and design change of the reference voltage select circuit are facilitated. Note that the disable signal may be propagated as the enable signal.

FIG. 17 shows an operation example of the reference voltage select circuit shown in FIG. 15.

As shown in FIG. 17, the reference voltage select circuit shown in FIG. 15 outputs the first and second reference voltages. V0 and V1 arranged in potential descending order or potential ascending order from the first to third select voltages $V_G$0 to $V_G$2 arranged in potential descending order or potential ascending order based on the data of bits of the 3-bit gamma correction data set at "1".

By propagating the signals (enable signal and disable signal) as described above by employing the switch elements or the switch cells including the switch elements, the number of switch elements or switch cells can be reduced even when realizing the reference voltage select circuit by using a switch matrix configuration.

In general, when realizing a circuit which selects the first and second reference voltages V0 and V1 from the first to third select voltages $V_G$0 to $V_G$2 by using a switch matrix configuration, it is necessary to provide six (=3×2) switch elements or switch cells.

However, the third select voltage $V_G$2 is not output as the first reference voltage V0 taking into consideration the characteristics in which two reference voltages are output in potential descending order or potential ascending order. Likewise, the first select voltage $V_G$0 is not output as the second reference voltage V1. Therefore, the switch element SW10 (switch cell SC10 including the switch element SW10) and the switch element SW11 (switch cell SC11 including the switch element SW11) can be omitted in FIG. 15.

In one embodiment of the invention, the reference voltage select circuit selects the first to Kth reference voltages arranged in potential descending order or potential ascending order from the first to Lth select voltages arranged in potential descending order or potential ascending order. Therefore, (L−K+1) switch cells are necessary in one embodiment of the invention for outputting one reference voltage. Therefore, the reference voltage select circuit can be realized by using K×(L−K+1) switch cells.

A specific circuit configuration example of the reference voltage select circuit according to one embodiment of the invention is described below.

Figure 18:
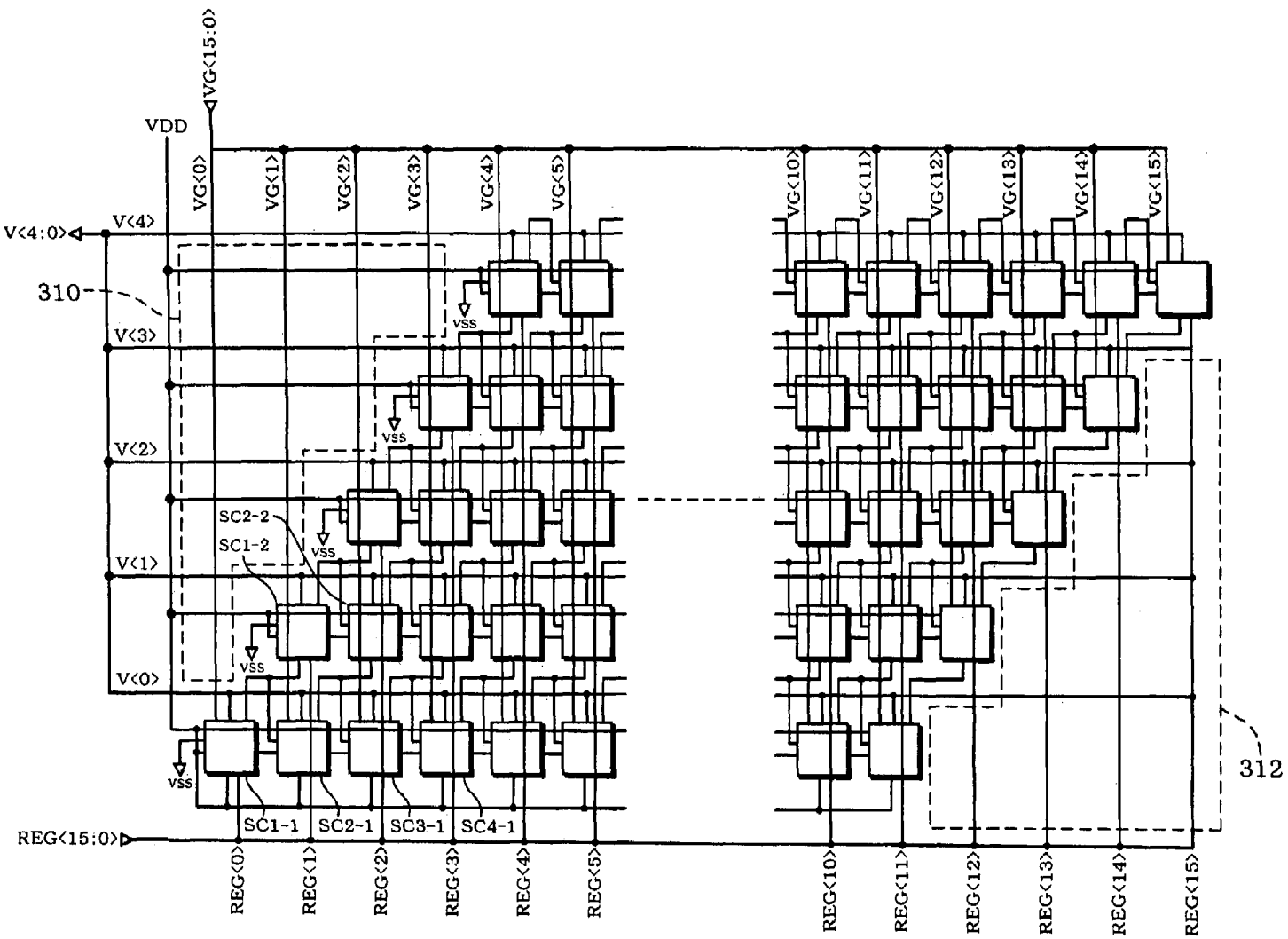
FIG. 18 is a diagram showing a specific circuit configuration example of the reference voltage select circuit according to one embodiment of the invention.

FIG. 18 shows a specific circuit configuration example of the reference voltage select circuit 210. FIG. 18 shows a configuration example in which L is sixteen (first to sixteenth select voltages $V_G$0 to $V_G$15) and K is five (first to fourth reference voltages V0 to V4).

VG<15:0> indicates the first to sixteenth select voltages $V_G$0 to $V_G$15. Each select voltage is supplied to the signal line for each bit of VG<15:0>. V<4:0> indicates the first to fourth reference voltages V0 to V4. Each reference voltage is supplied to the signal line for each bit of V<4:0>. REG<15:0> indicates the 16-bit gamma correction data.

While 80 (=5×16) switch cells are necessary when simply employing a switch matrix configuration, the reference voltage select circuit according to one embodiment of the invention can be realized by using 60 (=5×(16−5+1)) switch cells. This is because the switch cells in circuit sections 310 and 312 shown in FIG. 18 can be omitted for the above-described reason.

Figure 19:
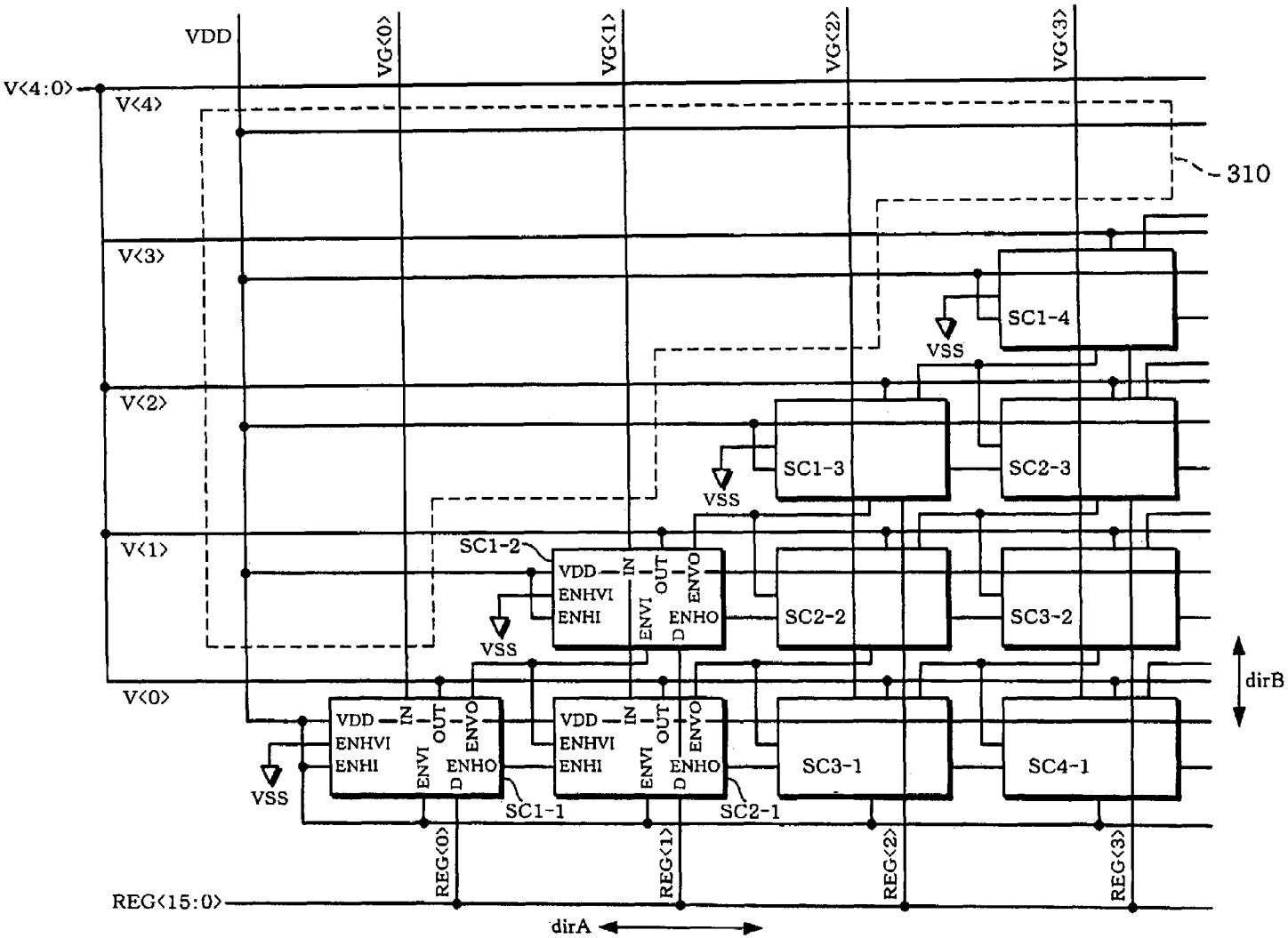
FIG. 19 is an enlarged diagram of a part of the circuit diagram of FIG. 18.

FIG. 19 is an enlarged diagram of a part of the circuit diagram shown in FIG. 18.

In FIG. 19, sections the same as the sections shown in FIG. 18 are indicated by the same symbols. Description of these sections is appropriately omitted. In FIG. 19, switch cells SC1-1, SC2-1, SC3-1, SC4-1, . . . , SC2-1, SC2-2, . . . have the same configuration.

Each switch cell includes a VDD terminal, an ENHVI terminal, an ENHI terminal, an ENVI terminal, a D terminal, an ENHO terminal, an ENVD terminal, an OUT terminal, and an IN terminal.

The VDD terminal is a terminal to which the high-potential-side power supply voltage VDD is supplied. In the switch cell, illustration of a terminal to which the low-potential-side power supply voltage VSS is supplied is omitted. The ENHVI terminal is a terminal to which the enable signal "enable" supplied to the cells arranged in a direction dirB is input. The ENHI terminal is a terminal to which the enable signal "enable" supplied to the cells arranged in a direction dirA (equivalent to the disable signal "dis" of which the logic level is reversed) is input. The ENVI terminal is a terminal to which the enable signal "enable" supplied to the cells arranged in the direction dirB is input. The ENHO terminal is a terminal from which the enable signal "enable" supplied to the cells arranged in the direction dirA (equivalent to the disable signal "dis" of which the logic level is reversed) is output. The D terminal is a terminal to which the data of each bit of the gamma correction data is input. The ENVD terminal is a terminal from which the enable signal "enable" supplied to the cells arranged in the direction dirB is output. The OUT terminal is a terminal from which the reference voltage is supplied. The IN terminal is a terminal to which the select voltage is supplied.

Therefore, the reference voltage select circuit may include the first to fourth switch cells SC1-1, SC2-1, SC1-2, and SC2-2, as shown in FIG. 19. The first switch cell SC1-1 includes a first switch element for outputting the first select voltage of the first to third select voltages arranged in potential descending order or potential ascending order as the first reference voltage of the first and second reference voltages arranged in potential descending order or potential ascending order. The second switch cell SC1-2 includes a second switch element for outputting the second select voltage as the first reference voltage. The third switch cell SC1-2 includes a third switch element for outputting the second select voltage as the second reference voltage. The fourth switch cell SC2-2 includes a fourth switch element for outputting the third select voltage as the second reference voltage.

The data of the first bit of the L-bit gamma correction data, the data of each bit of the gamma correction data being associated with one of the select voltages and indicating whether or not to output the select voltage as the reference voltage, is supplied to the first switch cell SC1-1, and the first switch cell SC1-1 outputs the enable signal to the second and third switch cells SC2-1 and SC1-2. The data of the second bit of the gamma correction data is supplied to the second switch cell SC2-1, and the second switch cell SC2-1 outputs the enable signal to the third and fourth switch cells SC1-2 and SC2-2. The data of the second bit of the gamma correction data is supplied to the third switch cell SC1-2, and the third switch cell SC1-2 outputs the enable signal to the fourth switch cell SC2-2. The data of the third bit of the gamma correction data is supplied to the fourth switch cell SC2-2.

In FIG. 19, the disable signal "dis" is output as the enable signal "enable". This is because the enable signal "enable" set to active is equivalent to the disable signal "dis" set to inactive and the enable signal "enable" set to inactive is equivalent to the disable signal "dis" set to active.

Figure 20:
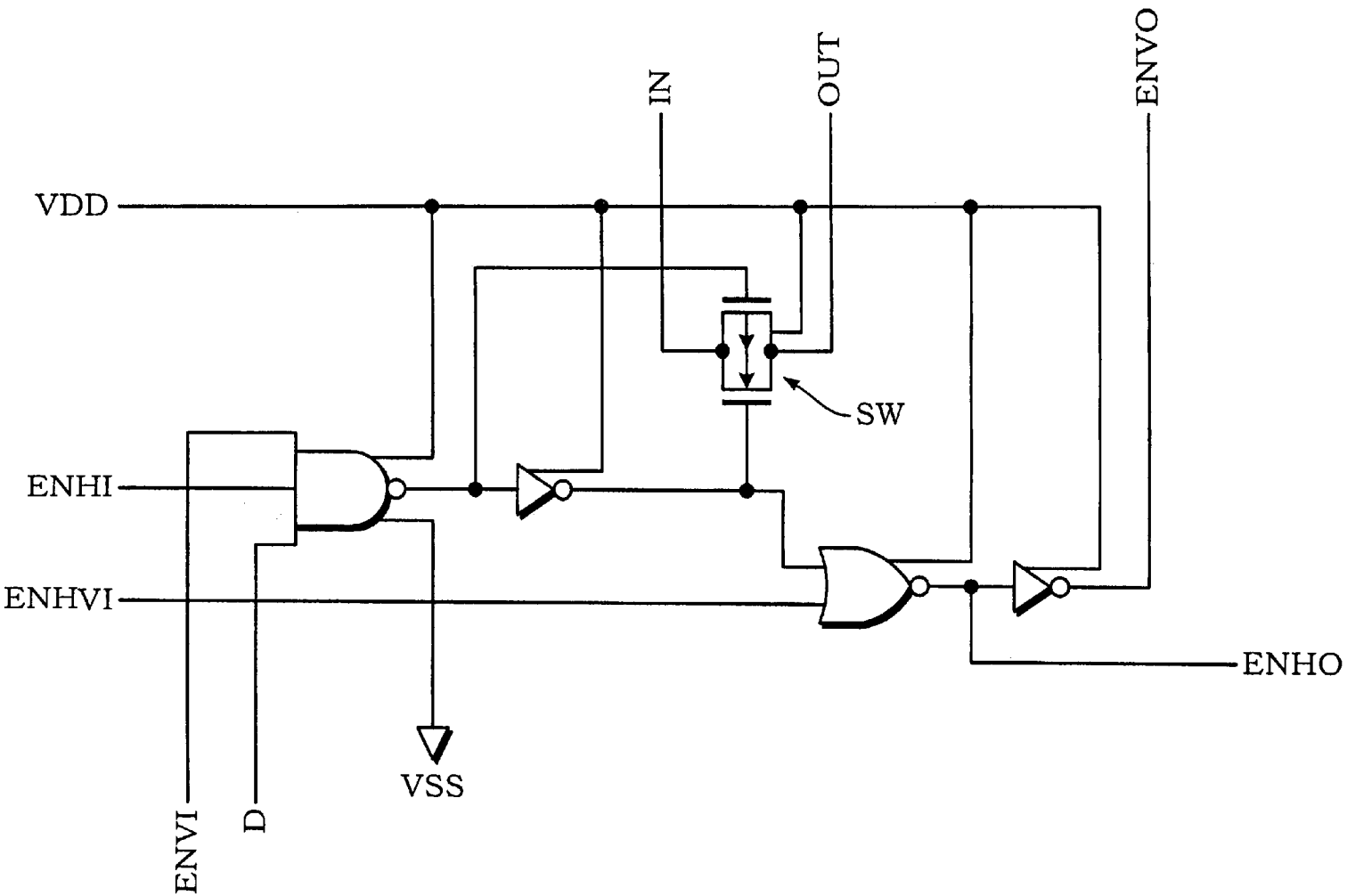
FIG. 20 is a diagram showing a circuit configuration example of a switch cell shown in FIG. 19.

FIG. 20 shows a circuit configuration example of the switch cell shown in FIG. 19.

In FIG. 20, the switch element SW is formed by using a transfer gate. When the AND result of the signals input through the ENVI terminal, the D terminal, and the ENHI terminal is "H", the switch element SW is set in a conducting state so that the IN terminal and the OUT terminal are set at the same potential. When the AND result is "L", the switch element SW is set in a nonconducting state.

The OR result of the AND result and the signal input through the ENHVI terminal is output from the ENVO terminal. The inversion result of the OR result of the AND result and the signal input through the ENHVI terminal is output from the ENHO terminal.

4.2 Modification

The gamma correction data setting circuit 222 according to one embodiment of the invention sets the parallel data in the gamma correction data register 220 in synchronization with the shift output of the shift register. However, the invention is not limited thereto.

A gamma correction data setting circuit 400 according to a modification of one embodiment of the invention sets the above mentioned parallel data in the gamma correction data register based on an address designating the write area of the gamma correction data register.

Figure 21:
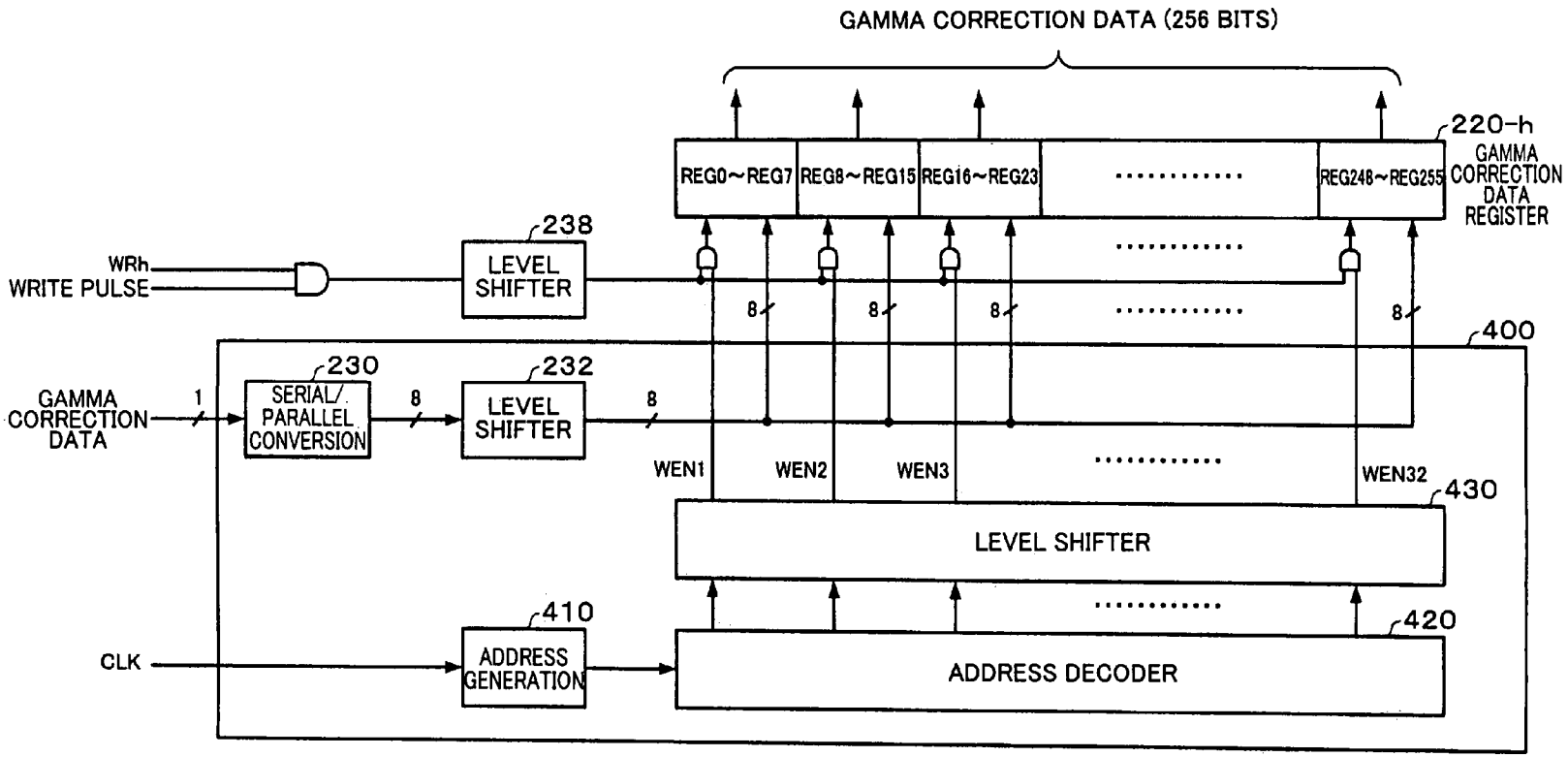
FIG. 21 is a block diagram of a configuration example of a gamma correction data setting circuit according to a modification of one embodiment of the invention.

FIG. 21 is a block diagram of a configuration, example of the gamma correction data setting circuit 400 according to the modification of one embodiment of the invention. In FIG. 21, sections the same as the sections shown in FIG. 10 are indicated by the same symbols. Description of these sections is appropriately omitted.

The reference voltage generation circuit 54 may include the gamma correction data setting circuit 400 according to this modification instead of the gamma correction data setting circuit 222 shown in FIG. 8.

The gamma correction data setting circuit 400 includes an address generation circuit 410, and sets the gamma correction data of which the signal level has been converted by the level shifter 232 in the gamma correction data register 220 based on the address generated by the address generation circuit 410. The function of the address generation circuit 410 may be realized by using a counter which counts the clock signal CLK as the input synchronization clock signal for the data of each bit of the gamma correction data.

The gamma correction data setting circuit 400 may include an address decoder 420 and a level shifter 430. The address decoder 420 decodes the address generated by the address generation circuit 410, and determines whether the write area indicated by the address is the area of the data REG0 to REG7, REG1 to REG15, . . . , or REG248 to REG255 of the bits of the gamma correction data. The decode result of the address decoder 420 is converted in signal level by the level shifter 430, and output as write enable signals WEN1 to WEN32.

For example, the clock signal CLK is counted, and only the write enable signal WEN1 is set to active when the count value is 1 to 8 for designating the write area of the data REG0 to REG7 of the bits of the gamma correction data. When the count value is 17 to 24, only the write enable signal WEN3 is set to active for designating the write area of the data REG16 to REG23 of the bits of the gamma correction data.

The write enable signals WEN1 to WEN32 are mask-controlled by the output of the level shifter 238.

According to this modification, it suffices to write the gamma correction data in the gamma correction data register 220 at low speed in synchronization with 32 write pulses instead of writing the gamma correction data in the gamma correction data register 220 at high speed in synchronization with 256 write pulses in the same manner as in one embodiment of the invention, for example. This significantly reduces power consumption required when setting the gamma correction data.

5. Electronic Instrument

Figure 22:
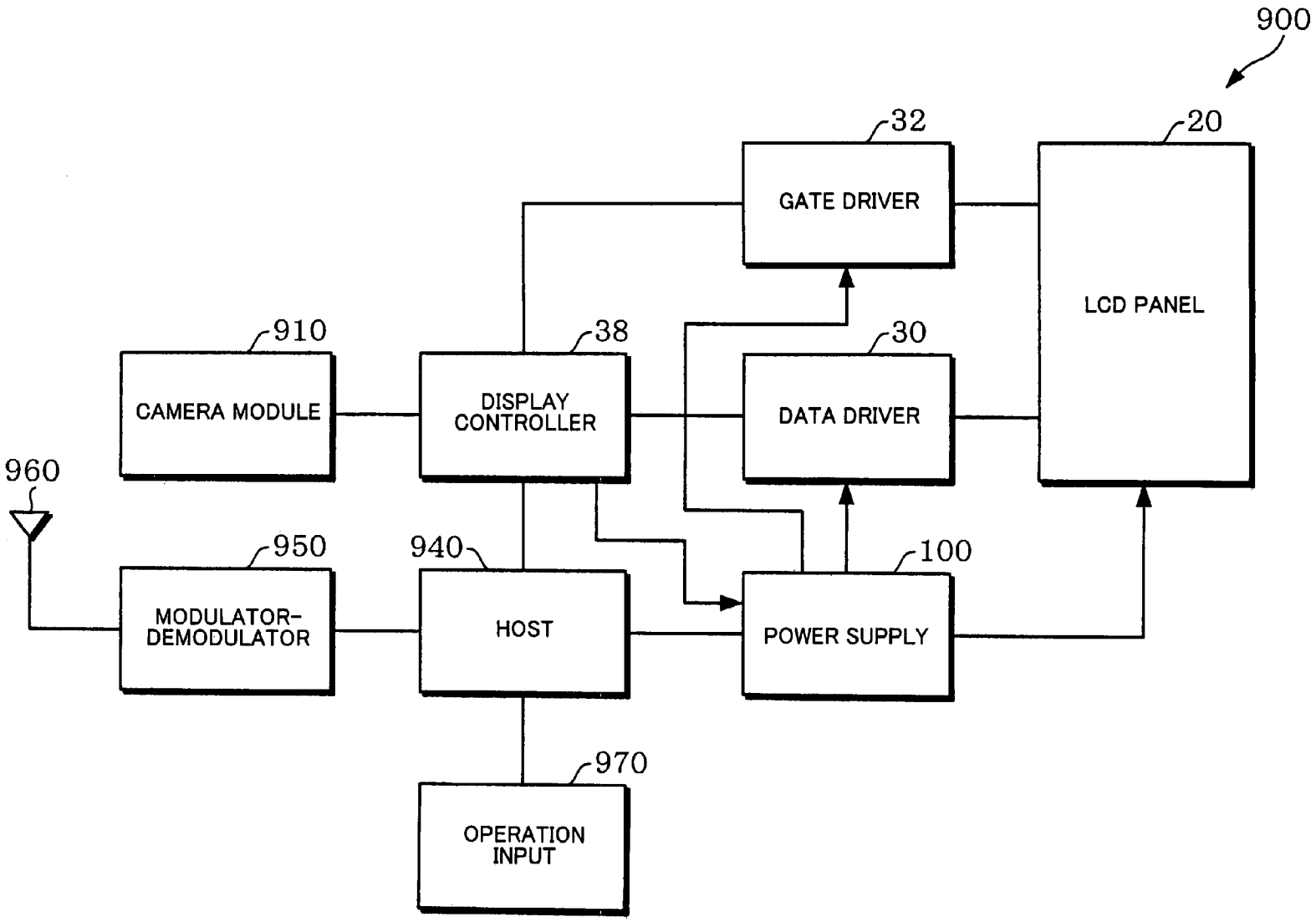
FIG. 22 is a block diagram of a configuration example of an electronic instrument according to one embodiment of the invention.

FIG. 22 is a block diagram showing a configuration example of an electronic instrument according to one embodiment of the invention. FIG. 17 is a block diagram showing a configuration example of a portable telephone as an example of the electronic instrument. In FIG. 22, sections the same as the sections shown in FIG. 1 or 2 are indicated by the same symbols. Description of these sections is appropriately omitted.

A portable telephone 900 includes a camera module 910. The camera module 910 includes a CCD camera, and supplies data of an image captured by using the CCD camera to the display controller 38 in a YUV format.

The portable telephone 900 includes the LCD panel 20. The LCD panel 20 is driven by the data driver 30 and the gate driver 32. The LCD panel 20 includes gate lines, source lines, and pixels.

The display controller 38 is connected with the data driver 30 according to one embodiment of the invention or its modification and the gate driver 32, and supplies display data in an RGB format to the data driver 30.

The power supply circuit 100 is connected with the data driver 30 and the gate driver 32, and supplies drive power supply voltages to the data driver 30 and the gate driver 32. The power supply circuit 100 supplies the common electrode voltage Vcom to the common electrode of the LCD panel 20.

A host 940 is connected with the display controller 38. The host 940 controls the display controller 38. The host 940 demodulates display data received through an antenna 960 by using a modulator-demodulator section 950, and supplies the demodulated display data to the display controller 38. The display controller 38 causes the data driver 30 and the gate driver 32 to display an image in the LCD panel 20 based on the display data.

The host 940 modulates display data generated by the camera module 910 by using the modulator-demodulator section 950, and directs transmission of the modulated data to another communication device through the antenna 960.

The host 940 transmits and receive display data, images using the camera module 910, and displays on the LCD panel 20 based on operational information from an operation input section 970.

The invention is not limited to the above-described embodiments. Various modifications and variations may be made within the spirit and scope of the invention. For example, the invention may be applied not only to drive the above-described liquid crystal display panel, but also to drive an electroluminescent or plasma display device.

The above-described embodiments illustrate an example in which the gamma correction data is read from the EEPROM. However, the invention is not limited thereto. The gamma correction data may be read from the host or an external circuit such as the display controller.

Part of requirements of any claim of the invention could be omitted from a dependent claim which depends on that claim. Moreover, part of requirements of any independent claim of the invention could be made to depend on any other independent claim.

Although only some embodiments of the invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A reference voltage generation circuit that generates a plurality of reference voltages to be used for gamma correction, the reference voltage generation circuit comprising:

first to Jth gamma correction data registers in which gamma correction data for generating the reference voltages is set, J being an integer greater than one; and a reference voltage select circuit that selects K select voltages from first to Lth select voltages arranged in potential descending order or potential ascending order and outputs the K select voltages as first to Kth reference voltages in potential descending order or potential ascending order, based on the gamma correction data set in one of the first to Jth gamma correction data registers, L being an integer greater than two, and K being an integer greater than one and smaller than L, the first to Kth reference voltages being output as the plurality of reference voltages, the reference voltage select circuit including:

a first switch element that outputs the first select voltage as the first reference voltage on condition that the first switch element is enabled by the data of a first bit of the gamma correction data, a second switch element that outputs the second select voltage as the first reference voltage on condition that the second switch element is disabled by the data of the first bit of the gamma correction data and enabled by the data of a second bit of the gamma correction data, a third switch element that outputs the second select voltage as the second reference voltage on condition that the third switch element is enabled by the data of the first bit of the gamma correction data and enabled by the data of the second bit of the gamma correction data, and a fourth switch element that outputs the third select voltage as the second reference voltage on condition that the fourth switch element is enabled by the data of the first bit of the gamma correction data, disabled by the data of the second bit of the gamma correction data, and enabled by the data of a third bit of the gamma correction data, and the reference voltage select circuit outputting at least the first reference voltage and the second reference voltage of the first to Kth reference voltages.

2. The reference voltage generation circuit as defined in claim 1, comprising:

a serial/parallel conversion circuit that converts the serially input gamma correction data into parallel data of a given number of bits; and a level shifter that converts a signal level of each bit of the parallel data, the parallel data having the signal level converted by the level shifter is being set in each of the first to Jth gamma correction data registers in units of the number of bits.

3. The reference voltage generation circuit as defined in claim 1, comprising:

a data setting register that designates one of the first to Jth gamma correction data registers in which the gamma correction data is set, the gamma correction data having the signal level converted by the level shifter being set in one of the first to Jth gamma correction data registers corresponding to a value set in the data setting register.

4. The reference voltage generation circuit as defined in claim 1, comprising:

an output setting register that designates one of the first to Jth gamma correction data registers from which the gamma correction data is output, the gamma correction data set in one of the first to Jth gamma correction data registers corresponding to a value set in the output setting register being output to the reference voltage select circuit.

5. The reference voltage generation circuit as defined in claim 1, when changing voltage levels of the reference voltages in a given polarity inversion cycle by using a polarity inversion drive method, a gamma correction data register selected from the first to Jth gamma correction data registers in a positive drive period being caused to differ from a gamma correction data register selected from the first to Jth gamma correction data registers in a negative drive period.

6. The reference voltage generation circuit as defined in claim 1, the gamma correction data being L-bit data, the data of each bit of the L-bit data being associated with one of the select voltages and indicating whether or not to output the select voltage as the reference voltage.

7. The reference voltage generation circuit as defined in claim 1 comprising:

first to fourth switch cells respectively including the first to fourth switch elements, the first switch cell activating a disable signal to the second switch cell and activating an enable signal to the third switch cell when the first switch cell is enabled by the data of the first bit of the gamma correction data, and the first switch cell deactivating the disable signal to the second switch cell and deactivating the enable signal to the third switch cell when the first switch cell is disabled by the data of the first bit of the gamma correction data, the second switch cell outputting the second select voltage as the first reference voltage and activating the enable signal to the fourth switch cell on condition that the second switch cell is enabled by the data of the second bit of the gamma correction data and a disable signal from the first switch cell is inactive, otherwise the second switch cell deactivating the enable signal to the fourth switch cell, the third switch cell outputting the second select voltage as the second reference voltage and activating the disable signal to the fourth switch cell on condition that the third switch cell is enabled by the data of the second bit of the gamma correction data and the an enable signal from the first switch cell is active, otherwise the third switch cell deactivating the disable signal to the fourth switch cell, and the fourth switch cell outputting the third select voltage as the second reference voltage on condition that the fourth switch cell is enabled by the data of the third bit of the gamma correction data, a disable signal from the third switch cell is inactive, and an enable signal from the second switch cell is active.

8. A display driver that drives a plurality of data lines of an electro-optical device, the display driver comprising:

the reference voltage generation circuit as defined in claim 1;

a voltage select circuit that selects a reference voltage corresponding to grayscale data from the first to Kth reference voltages from the reference voltage generation circuit, and outputs the selected reference voltage as a data voltage; and a driver circuit that drives one of the plurality of data lines based on the data voltage.

9. An electro-optical device comprising:

a plurality of scan lines;

a plurality of data lines;

a pixel electrode specified by one of the plurality of scan lines and one of the plurality of data lines;

a scan driver that scans the scan lines; and the display driver as defined in claim 8 that drives the plurality of data lines.

10. An electronic instrument comprising the display driver as defined in claim 8.

11. An electronic instrument comprising the electro-optical device as defined in claim 9.

* * * * *